US009752427B2

(12) United States Patent
Douglas et al.

(10) Patent No.: US 9,752,427 B2
(45) Date of Patent: Sep. 5, 2017

(54) STATOR BORE GAGE

(71) Applicant: GAGEMAKER, LP, Pasadena, TX (US)

(72) Inventors: James R. Douglas, Houston, TX (US); Kris L. Dawson, Pearland, TX (US); Craig Cloud, New Braunfels, TX (US)

(73) Assignee: GAGEMAKER, LP, Pasadena, TX (US)

( * ) Notice: Subject to any disclaimer, the term of this patent is extended or adjusted under 35 U.S.C. 154(b) by 137 days.

(21) Appl. No.: 14/921,210

(22) Filed: Oct. 23, 2015

(65) Prior Publication Data

US 2016/0115781 A1 Apr. 28, 2016

Related U.S. Application Data

(60) Provisional application No. 62/068,936, filed on Oct. 27, 2014.

(51) Int. Cl.
*E21B 47/08* (2012.01)

(52) U.S. Cl.
CPC ..... *E21B 47/08* (2013.01)

(58) Field of Classification Search
CPC ..... E21B 47/08
USPC ..... 33/544, 544.1, 544.2, 544.3
See application file for complete search history.

(56) References Cited

U.S. PATENT DOCUMENTS 3,977,468 A * 8/1976 Brewer ..... E21B 17/1021 166/241.5
4,524,524 A * 6/1985 Frank ..... G01B 5/08 33/199 R
4,653,318 A 3/1987 Jadwin et al.
4,722,142 A * 2/1988 Schmidt ..... G01B 7/105 324/230
2005/0279498 A1* 12/2005 Nakajima ..... E21B 47/08 166/255.2
2006/0249307 A1* 11/2006 Ritter ..... E21B 47/082 175/40
2009/0101337 A1* 4/2009 Neidhardt ..... E21B 47/08 166/250.01
2011/0116959 A1 5/2011 Akbari et al.
2011/0314685 A1 12/2011 Casa
2015/0000979 A1* 1/2015 Farrag ..... E21B 47/09 175/45
2016/0032710 A1* 2/2016 Hu ..... E21B 47/08 33/544.2
2016/0237808 A1* 8/2016 Watanabe ..... E21B 47/08
(Continued)

FOREIGN PATENT DOCUMENTS

CN 2760505 2/2006

OTHER PUBLICATIONS

Thomas, S., International Search Report for International Patent Application No. PCT/US15/57218, ISA/US, dated May 6, 2016.
(Continued)

*Primary Examiner* — G. Bradley Bennett
(74) *Attorney, Agent, or Firm* — Sutton McAughan Deaver PLLC

(57) ABSTRACT

A stator bore gage comprises a detector assembly comprising a wheel configured to engage an inside surface and to transduce the varying surface diameters into electrical or optical signals representative of the condition of the inside surface as the detector traverses the inside surface.

20 Claims, 26 Drawing Sheets

(56) References Cited

U.S. PATENT DOCUMENTS

2016/0245069 A1* 8/2016 Toniolo ..... E21B 47/08

OTHER PUBLICATIONS

Thomas, S., Written Opinion for International Patent Application No. PCT/US15/57218, ISA/US, dated May 6, 2016.
Gagemaker, "Product Information—Mud Motor Power Section", pp. 69-77, copyright 2012 by Gagemaker, LP, retrieved from the Internet on Jan. 22, 2015 using [<http://issuu.com/gagemaker/docs/6-2013_gagemaker_catalog_send_/1?e=19093577/30133759>].

* cited by examiner

SBG - 3000 Measurement Data - Notepad

File Edit Format View Help

| Date/Time | Pump Model # | Pump Serial # | Core # | Operator ID # | Temperature | Standard Size | Standard Serial # | Comments | Average | Reading 1 |
|---|---|---|---|---|---|---|---|---|---|---|
| 10/14/2015 12:20:05 AM | KB1564 | A1F5567 | C4561 | 345 75F | 1.254000 A2A1 | 1.2419 | 1.2410 1.2408 | 1.2403 1.2439 | 1.2416 1.2404 | 1.2424 1.2422 |
| 10/14/2015 12:20:39 AM | KB1564 | A1F5567 | C4561 | 345 75F | 1.254000 A2A1 | 1.2401 | 1.2404 1.2389 | 1.2391 1.2396 | 1.2401 1.2427 | |

FIG. 10H

STATOR BORE GAGE

CROSS REFERENCE TO RELATED APPLICATIONS

This application claims benefit of and priority to U.S. Provisional Application Ser. No. 62/068,936, filed on Oct. 27, 2014, the entire contents of which are incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to systems and methods for use in inspecting the stator section of motors and pumps having constructions similar to mud motors and Moyno-style pumps.

Description of the Related Art

Certain devices (e.g., certain motors and pumps) have lobed stators, the dimensions of which are important to the proper operation of the device, for example, downhole oilfield operations often utilize mud motors and municipal water systems often use Moyno-style pumps to transfer viscous materials. For purposes of the following discussion, a mud motor is described as one such exemplary device although it should be understood that the described subject matter is applicable to other devices.

At a high level, a mud motor is a form of a positive displacement pump that includes an elongated rotor section and an elongated stator section. The rotor section is typically formed of a hardened material, such as steel, and has an outer profile that defines one or more helically shaped lobes. The stator section typically defines a central bore and has a generally spiral fluted interior that defines a number of lobes, where the number of lobes defined by the stator interior is different from—and typically greater than—the number of lobes defined by the rotor exterior. The interior of the stator bore is commonly formed from, or lined with an elastic, deformable material, such as rubber.

A representative section of an exemplary mud motor, taken from prior art Patent Application Publication, US 2011/0116959, is illustrated in FIG. 1 (Prior Art). In the illustrated figure, the mud motor rotor is reflected by element 302 and the mud motor stator is reflected by element 308. As illustrated, the interior of the stator bore 304 defines a number of different ridge-like elements that may define a number of maximum interior stator bore diameter "valleys" and a plurality of ridges defining a plurality of minimum interior stator bore diameter ridges. Because of the shape of the stator bore interior, one would encounter a number of both ridges and valleys if one were to traverse the stator bore along its elongated (i.e., longitudinal) axis. Thus, the shape of the interior bore is non-uniform and the exact diameter of the interior diameter of the stator bore may change as one moves along its elongated axis. For most mud motor stator bores, the interior stator bore diameter dimension may transition back and forth from a dimension corresponding generally to the maximum interior diameter to one corresponding generally to the minimum interior dimension as one moves from one end of the stator bore to the other along its elongated axis.

In operation, a pressurized fluid (which may take the form of drilling fluid, drilling mud, compressed air or other gas, or any other suitable fluid) is forced through the space between the rotor and the stator and produces a torque that causes the rotor to rotate. The rotating rotor is commonly coupled to a drill bit through a drive shaft to facilitate a drilling operation.

A proper fit between the rotor and the stator of a mud motor is important to proper operation of the motor. To ensure a proper fit, it is often helpful to have accurate measurement data associated with the minimum diameters of the stator bore. Knowing these dimensions can allow one to select a properly sized rotor for a given stator and/or determine that the rubber interior of a previously used stator needs to be reworked or replaced. Moreover, knowing these dimensions can potentially allow one to determine the wear levels of a stator and/or whether different regions of the stator interior are wearing at different levels than other regions. Stator bore gages are sometimes used to obtain information about the interior diameters of mud motor stators.

Known stator bore gages, such as the SBG-5000 Stator Gage offered by Gagemaker, typically use a broad base, relatively elongated gage head with a floating element shoe to measure the minimum internal diameter of a mud motor stator at various discrete locations. The elongated gage head typically spans a plurality of stator bore ridges. In such gages, the gage is typically preset or calibrated using a round setting standard and then inserted into the interior bore of the stator to be inspected. The gage is then placed at predetermined location intervals, and at each of the predetermined locations, the operator actuates a lever to take a dimensional reading either from an analog indicator or from a digital readout box. The dimensional measurements can then be analyzed to provide information about the minimum stator bore diameter. Flat, elongated stator bore gage extension shoes can be used with such devices to allow use of the gage in stators of varying sizes. In some instances, the gage can include an electronic measuring device and a wired connection for providing the measurement data to a computing device (such as a laptop computer) for display and processing.

A representative example of a prior art stator bore gage 200 as described is illustrated in FIG. 2. As reflected in the figure a broad-based head 202 having a broad, elongated floating measurement shoe is coupled by an elongated (commonly stainless steel or carbon fiber) ridged shaft 204 to a handle element 206 having a movable lever. The handle element 206 is coupled by a connection cable 208 to a computing device (such as a portable desktop or laptop computer) 210 that receives power via a standard power cord 212. An elongated flat shoe 214 may be used for stator bores of a large diameter. In use, the stator bore gage 200 is inserted into a stator bore and the operator moves the head 202 to a first location and activates the lever on the handle element 206 to take a first reading. The operator then moves the head 202 to a different point and takes a second reading. This procedure may be repeated a number of times to take discrete measurements at specific locations.

While known gages, such as the one described in connection with FIG. 2, are capable of providing accurate information concerning the internal dimensions of a mud motor stator bore, time is required for the taking of the various discrete measurements and the accuracy of the measurements can vary depending on where the discrete measurements are taken and the hand position of the user at the time the measurements are taken. Moreover, because the head 202 spans several stator bore ridges, individual measurements of the various minimum diameters within the stator bore are not obtained.

BRIEF SUMMARY OF THE INVENTION

The inventions taught herein are summarized in non-limiting fashion thought out this disclosure with respect to one or more different embodiments, none of which are intended to limit the scope of the inventions taught or the appended claims. A brief summary of at least one of the inventions taught herein includes a device for measuring a plurality of inside diameters of an interior surface, comprising a detector assembly with a body, a wheel assembly and a transducer assembly; the body having a slide portion configured for sliding contact with an interior surface of a component; the wheel assembly coupled to the body substantially opposite the slide portion such that at least a portion of the wheel assembly protrudes from the body for rolling contact with the interior surface; the detector assembly configured for relative displacement between the wheel assembly and the slide portion in response to changes in the interior surface diameter; the transducer assembly located in the body, coupled to the wheel assembly and configured to transduce displacement of the wheel assembly into electrical signals representative of an interior surface diameter of the component; and a translation assembly coupled to the detector assembly and configured to insert the detector assembly into the interior of the component and to withdraw the detector assembly from the interior of the component.

Other brief and non-limiting summaries of the inventions taught herein can be found in the description of embodiments below and separately from the appended claims.

BRIEF DESCRIPTION OF THE SEVERAL VIEWS OF THE DRAWINGS

The following figures form part of the present specification and are included to further demonstrate certain aspects of the disclosed embodiments.

in accordance with various teachings herein.

FIGS. 10A-10H illustrate simulated "screenshots" of an exemplary man-machine interface that can be used with a stator bore gage as taught herein and a method of using the described stator bore gages.

Figure 1:
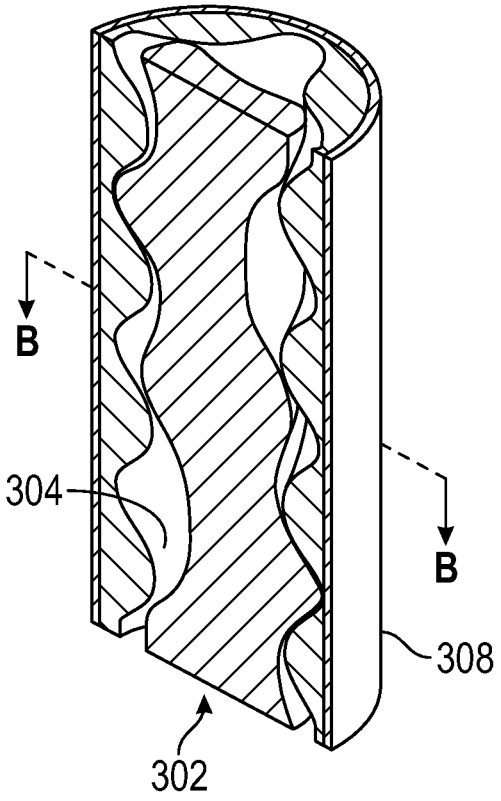
FIG. 1 (Prior Art)
FIG. 1 illustrates a prior art mud motor.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

In general, the inventions taught herein may be implemented in a variety of devices capable of measuring a plurality of inside diameters of an interior surface. Such devices may comprise a detector assembly having a body, a wheel assembly and a transducer assembly, the body having a slide portion configured for sliding contact with an interior surface of a component. The wheel assembly may be coupled to the body substantially opposite the slide portion such that at least a portion of the wheel assembly protrudes from the body for rolling contact with the interior surface. The detector assembly may be configured for relative displacement between the wheel assembly and the slide portion in response to changes in the interior surface diameter. The transducer assembly may be located in the body, coupled to the wheel assembly and configured to transduce displacement of the wheel assembly into electrical signals representative of an interior surface diameter of the component. A translation assembly may be coupled to the detector assembly and configured to insert the detector assembly into the interior of the component and to withdraw the detector assembly from the interior of the component.

Such embodiments may also comprise a support mechanism that converts radial displacement of the wheel assembly into longitudinal displacement. The transducer assembly may comprise a linear displacement sensor. The wheel assembly may provide about 0.2 inches of radial displacement. The wheel assembly may comprise a biasing element configured to bias the wheel to a maximum radial displacement from the slide portion. The biasing force supplied by the biasing element may be such that it does not cause deformation of the interior surface. The biasing force supplied by the biasing element may be about 0.3 pounds or less. The translation assembly may comprise a handle portion having a power source and a conduit for communicating signals from the transducer assembly to the handle portion. The translation assembly may have has an adjustable length. The translation assembly may comprise one or more joints configured to allow relative movement between the body and the handle. The one or more joints may be a ball and socket joint or a u-joint. The detector assembly may be configured to make continuous measurements of the interior surface diameters. The body may comprise one or more removable shoes each shoe having a slide portion.

Embodiments of the inventions taught herein may also comprise a man-machine interface with a visual display configured to show representations of the electrical signals from the transducer assembly. The man-machine interface may be associated with the handle portion. The man-machine interface may communicate wirelessly with the detector assembly.

Other embodiments of the inventions taught herein may comprise devices capable of measuring a plurality of inside diameters of a positive displacement motor stator and may further comprise a detector assembly comprising a body, a wheel assembly and a transducer assembly. The body may have one or more slide portions configured for sliding contact with an interior surface of the stator. The wheel assembly may be coupled to the body substantially opposite the at least one slide portion such that at least a portion of the wheel assembly protrudes from the body for rolling contact with the interior surface of the stator. The detector assembly may be configured for relative displacement between the wheel assembly and the at least one slide portion in response to changes in the interior surface diameter. The transducer assembly may be located in the body, operatively coupled to the wheel assembly and configured to transduce displacement of the wheel assembly into electrical signals representative of an interior surface diameter of the stator. A translation assembly may be coupled to the detector assembly and configured to insert the detector assembly into the interior of the stator and to withdraw the detector assembly from the interior of the stator. The translation assembly may have an adjustable length and may further comprise a handle portion having a power source and a conduit for communicating signals from the transducer assembly to the handle portion translation and one or more joints configured to allow relative rotation between the body and the handle. A man-machine interface may be provided and configured to wirelessly communicate with the body and to display the diametrical measurements of the interior surface as the body is withdrawn from the stator.

Other embodiments of the inventions taught herein may comprise methods of measuring a plurality of inside diameters of an interior surface of a component with a device such as described above, but not limited only to such devices. Such methods may comprise calibrating the device so that the electrical signals provided by the transducer assembly are associated with diametrical measurements. Setting a maximum diametrical dimension between the slide portion and the wheel assembly to fit the interior surface to be measured. Inserting the body into the interior of the component. Measuring the diameter of the interior surface as the body is withdrawn from the component.

Such methods may also comprise determining a minimum diameter of the interior surface of the component. Displaying the diametrical measurements of the interior surface as the body is withdrawn from the component on a man-machine interface configured to wirelessly communicate with the body. Calibrating the device so that the electrical signals provided by the transducer assembly are associated with diametrical measurements. Setting the maximum diametrical dimension between the slide portion and the wheel assembly to fit the interior surface to be measured. Inserting the body into the interior of the stator. Measuring the diameter of the interior surface as the body is withdrawn from the stator. Determining a minimum diameter of the interior surface of the stator. Determining the size of a rotor for use with the stator based on one or more of the diametrical measurements obtained while withdrawing the body from the stator.

Describing now in more particularity a few of the many possible embodiments of the devices and methods that can be used to implement the inventions taught herein, we refer to the drawings. In particular, FIGS. 3A and 3B illustrate an improved apparatus 300 for inspecting a mud motor power system and, in particular, a stator bore.

In the illustrated embodiment, the apparatus 300 includes a handle element 310 that, in some embodiments, can house battery-operated electronics useful in the operation of the apparatus 300 and one or more rechargeable batteries for powering the electronics.

Figure 3A:
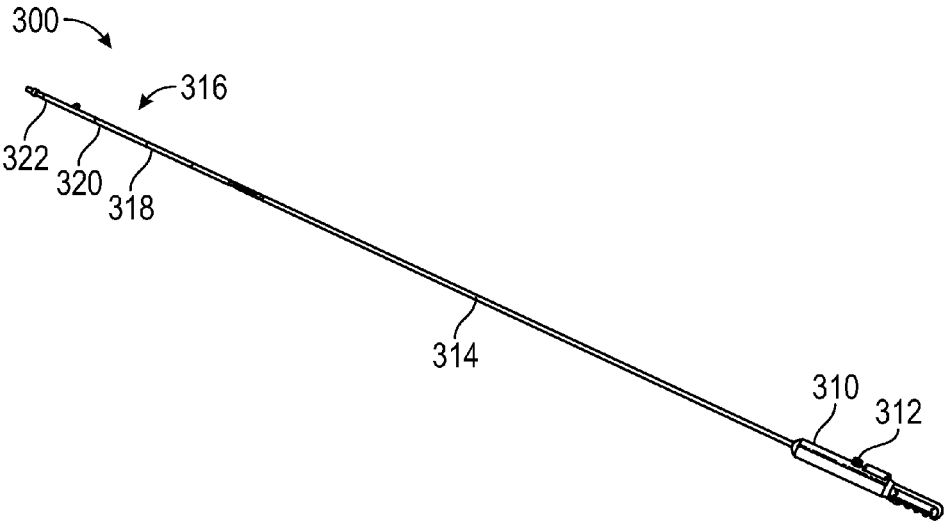
FIGS. 3A and 3B illustrate an exemplary stator bore gage constructed in accordance with certain teachings herein.
Figure 3B:
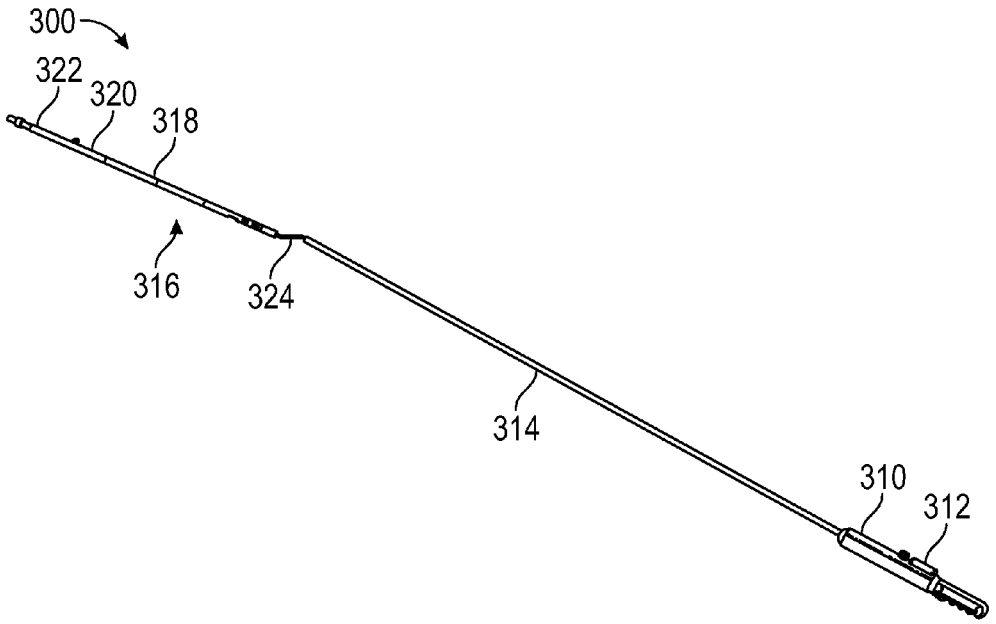

Although not illustrated in FIG. 3A or 3B, the apparatus 300 may also be used with a man machine interface. The man machine interface may take many forms including, but not limited to: a dedicated device including a screen an interface circuitry coupled to the apparatus 300 via a wired or wireless (e.g., Bluetooth, RF, IR etc.) link; a programmed general purpose computer linked to the apparatus 300 vie a wired or wireless link or a hand-held device such as a table or a smart-phone (e.g., an Android or iOS service) running a dedicated application designed for use with the apparatus 300. Other forms of man machine interfaces can be used without departing from the teachings herein In the example of FIGS. 3A and 3B, the handle element 310 also includes a button 312 for powering the electronics within the housing on and off. The handle element 310 can be made from any suitable material. In the embodiment of FIGS. 3A and 3B, it is made of molded plastic.

The handle element 310 in the illustrated example is coupled to a handle tube 314. The handle tube should be of a size sufficient to fit inside the smallest stator bore to be inspected with the apparatus 300. For the inspection of shorter mud motor power section stators, the handle tube may be long enough to allow the detection elements of apparatus 300 (discussed below) to extend all the way into the stator bore to be inspected such that the detection elements can be located at (or just outside) one open end of the stator bore and the handle element 310 can be located outside the other open end of the stator bore, with the handle tube 314 extending through the stator bore there between. In other embodiments, for use with longer stator bore sections, the handle tube 314 may be sized to allow the detecting elements to extend to, and preferably beyond, the midpoint of the longest stator bore to be inspected such that, by operating the apparatus 300 from both ends of the stator under inspection, measurements may be taken at all points along the stator bore.

The handle element 310 is preferably hollow and/or has embedded conductors for transmission of an electric signal or optical signal from the detection sensor (described below) to the electronics in the handle element 310 and/or of power from the handle element 310 to the sensor. The electronics in the handle 310 may comprise one or more memory systems to record measurement data, other relevant data obtained during use, and/or operational programs or software for the apparatus 300. One or more of the memory systems may comprise a removable memory system, such as, but not limited to, USB-based removable memory; or SD or micro SD memory chips. It is preferred, but not required, that the memory systems be configured to allow continuous recording of measurement data. Continuously recorded measurement data can be analyzed in quasi-real-time to provide feedback during the measurement process, or the continuously recorded data can be analyzed later to produced detailed reports on the measurement process. In addition, or alternately, the electronics may comprise a wireless communication system, such as, but not limited to, a Bluetooth communication standard, configured to stream or batch measurement data to a website, cloud-based system, computer and/or remote recording system.

Further, the electronics may comprise one or more sensor feedback systems, including, but not limited to, a circuit for providing an audible indication to the apparatus 300 user; a circuit for providing visual indication to the apparatus 300; a circuit for providing a vibratory indication to the apparatus 300 user; or any combination of such feedback systems. A purpose of these feedback indication systems may be to incentivize the user of the apparatus 300 to look at the position of the apparatus within the stator bore, rather than to focus on a screen or other display of measurement data. In this way, operator errors caused by inadvertently moving the apparatus with the bore (e.g., jacking or jawing the device within the bore) may be minimized.

The handle element 310 is preferably formed from a substantially ridged lightweight material, such as aluminum or an appropriate plastic or composite material. In one embodiment, the handle tube 314 is constructed from carbon fiber, which allows the element to be both very strong and lightweight.

The end of the handle tube 314 opposite the handle element 310 is coupled to a detector assembly. In the illustrated example, the detector assembly is formed in three main sections: an end assembly 318, a middle assembly 320 and a wheelhouse assembly 322. At a high level, in the exemplary illustrated embodiment, the wheelhouse assembly 322 includes a wheeled contact element that is capable of movement in a direction generally perpendicular (i.e., normal) to the elongated or longitudinal axis of the handle tube 314. For ease of reference, the axis extending along the length of the handle tube 314 is referred to as the longitudinal or "X" axis; the axis reflecting movement of the wheeled contact element is referred to as the "Y" axis; and the axis perpendicular both the X and the Y axis is referred to as the "Z" axis.

In the depicted embodiment, the wheeled contact element is coupled mechanically to a transfer mechanism and a transfer shaft that converts the generally Y-axis movement of the wheeled contact element into X-axis movement of the transfer shaft. In that embodiment, the transfer shaft is coupled to a linear sensor that converts the X-axis movement of the shaft into electrical signals passed by one or more conductors (represented by element 324 in FIG. 3B) to the electronics in the handle element 310. In general, operation, the apparatus is powered on, calibrated (optionally) and the detector assembly is then inserted into and removed from the stator bore of a stator to be inspected. As the gauge is being inserted into the stator bore and/or as it is being removed from the stator bore, movement of the contact wheel causes the sensor to provide electrical signals, including varying electrical signals, to the electronics in the handle assembly, These signals are processed by the electronics to provide useful information concerning the stator bore interior conditions that may include, but are not limited to, the minimum internal diameter dimension.

Figure 4:
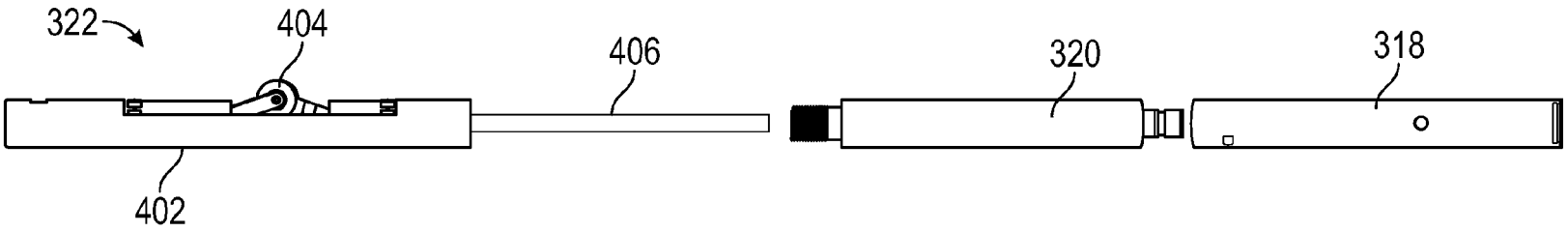
FIG. 4 illustrates aspects of the stator bore gage of FIG. 4.

FIG. 4 illustrated additional details of representative embodiments of the wheelhouse assembly 322, the middle assembly 320 and the end assembly 318. For purposes of illustration, the wire running from the sensor within the end assembly 318 is not illustrated. In the example embodiment, the main components of the wheelhouse assembly 322, the middle assembly 320 and the end assembly 318 are all formed form metal.

Referring first to FIG. 4, the wheelhouse assembly 322 includes a wheelhouse housing 402 and a contact wheel 404 that can move along an axis perpendicular to the elongated axis of the wheelhouse assembly 322. As illustrated, the contact wheel 404 is designed such that it spins in the direction of insertion/removal as the detector assembly is inserted into and removed from the stator bore under inspection. As shown in FIG. 4, the contact wheel 404 is coupled to a transfer shaft 406 that moves back and forth along the elongated axis of the detector assembly (i.e., along the X axis) as the contact wheel 404 moves in the Y axis. As shown, in the illustrated embodiment, the transfer shaft 406 is of a sufficient length to extend through a hollow bore formed within the interior of the middle element 320.

FIGS. 5A-5F illustrate the exemplary wheelhouse assembly 322 in greater detail. In some of these figures, the wheelhouse housing 402 is rendered transparent so that the interior components are rendered visible.

As shown in FIGS. 5A, 5B, 5C, 5D and 5F the wheelhouse assembly 322 includes a main wheelhouse housing 402 that defines an open cavity therein. Positioned within the cavity is a first member or element 502 that has one end positioned (by a mounting pin 518 or other suitable mechanism) in a fixed relationship to the wheelhouse housing 402 and another end coupled to the contact wheel 404. The element 502 is coupled to the wheelhouse housing 402 and the contact wheel 404 such that the end of the element in the wheelhouse housing is fixed and cannot move along the X direction 520, but can pivot as the other end of the element 502 arcs about the fixed point generally along the Y axis 522 as the contact wheel 404 moves up and down as the contact wheel 404 rotatably traverses the interior of the stator bore.

A second member or element 504 is also coupled to the contact wheel 404. The second element 504 has one end that is coupled to the contact wheel and another end that is not fixed with respect to the X-axis 520 and that is coupled to one end of the transfer shaft 406. As reflected in the figures, movement of the contact wheel 404 generally in the Y direction 522 may result in the transfer shaft moving in the X direction 520.

In the specific embodiment illustrated in FIGS. 5A, 5B, 5C and 5D, the relationship between a given increment of movement of the contact wheel 404 in the Y direction and the resultant movement of the transfer shaft in the X direction is not necessarily the same and the amount of X movement of the shaft that one may get for a given increment of Y movement 522 may not necessarily be constant, but may vary depending on the exact location of the contact wheel 404 and the first and second elements 502 and 504 over the increment of movement. Accordingly, to ensure accurate measurements, the described apparatus may typically be initially characterized to reflect the specific relationship between Y movement of the contact wheel 404 and the X movement 520 of the transfer shaft 406. An exemplary initial calibration method is described below.

Figure 5A:
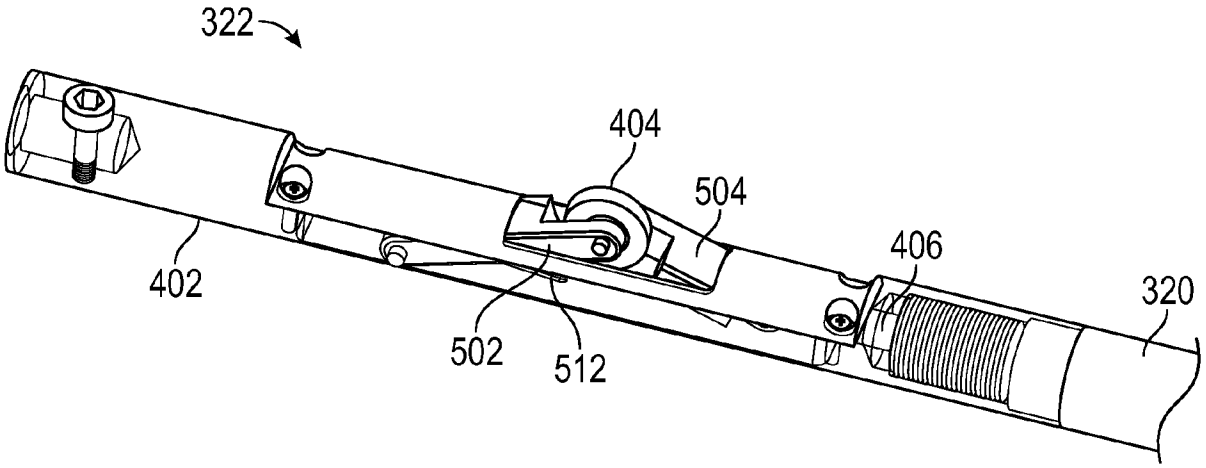
FIGS. 5A-5F illustrate representative features of an end section of a stator bore gage constructed in accordance with various teachings herein.
Figure 5B:
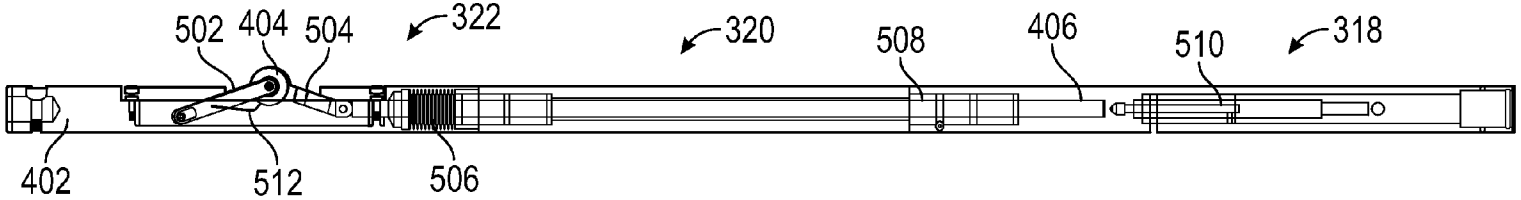
Figure 5C:
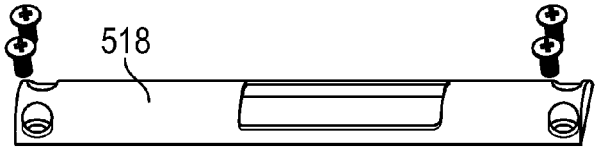
Figure 5C:
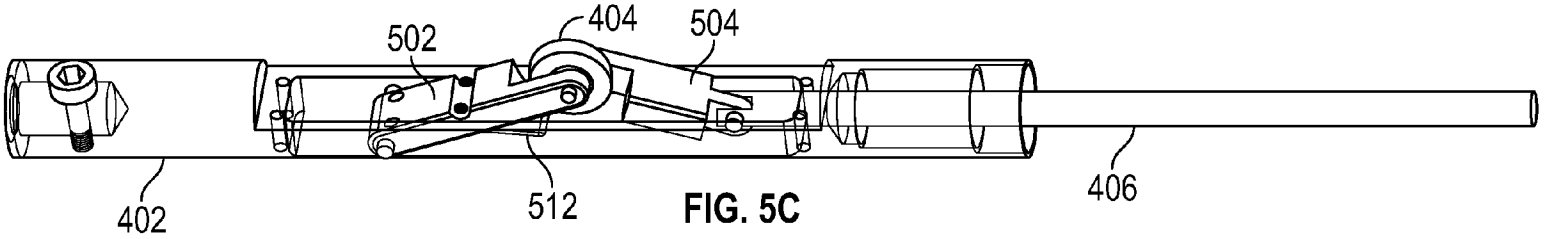
Figure 5D:
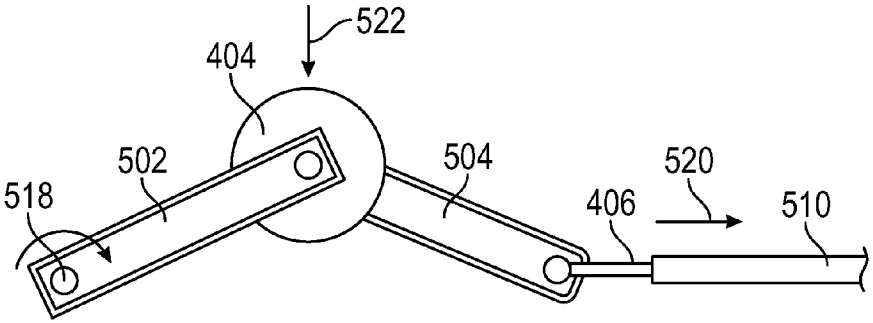

Referring to FIGS. 5A and 5B, it may be seen that the transfer shaft 406 extends into and through the middle assembly 320. In the illustrated example, bushing assemblies 506 and 508 are provided to facilitate smooth movement of the transfer shaft 406. The middle assembly 320 may be coupled to the wheelhouse assembly 322 in any suitable fashion. In the embodiment described herein, the connection is made via a screw-connection where a threaded male end of the middle assembly 320 is received in a threaded socket of end assembly 322.

As best reflected in FIG. 5B, the end of the transfer shaft 406 that extends through the middle assembly 320 and generally abuts a linear sensor 510 positioned within the middle assembly 318. It should be noted that in FIG. 5B the transfer shaft 406 is, for purpose of illustration, shown as not actually touching the sensor 510. However, in any actual physical embodiment, the shaft end may in fact likely actually contact the sensor end.

In the embodiment of FIGS. 5A-5D, the linear sensor 510 exerts a force along the X direction that generally tends to cause the contact wheel 404 to move towards its position along the Y-axis that is most distant from the wheelhouse housing 402. For many embodiments, this force may be enough to cause the contact wheel 404 to move to its "outermost" position along the Y-axis when there is no pressure being exerted against the contact wheel 404 (which is typically the position when the detector assembly is outside a stator bore). In other embodiments, such as the one illustrated in FIGS. 5A-5C a kick spring, such as spring 512, may be used to ensure that the contact wheel 404 is properly biased.

In alternative embodiments, the kick spring alone may be insufficient to properly bias the contact wheel and ensure that the wheel is pressed against the inner diameter of the stator bore to be inspected with appropriate force. In such applications an external biasing spring may be used (alone or in combination with the kick spring) to control and adjust the contact wheel bias.

Figure 5E:
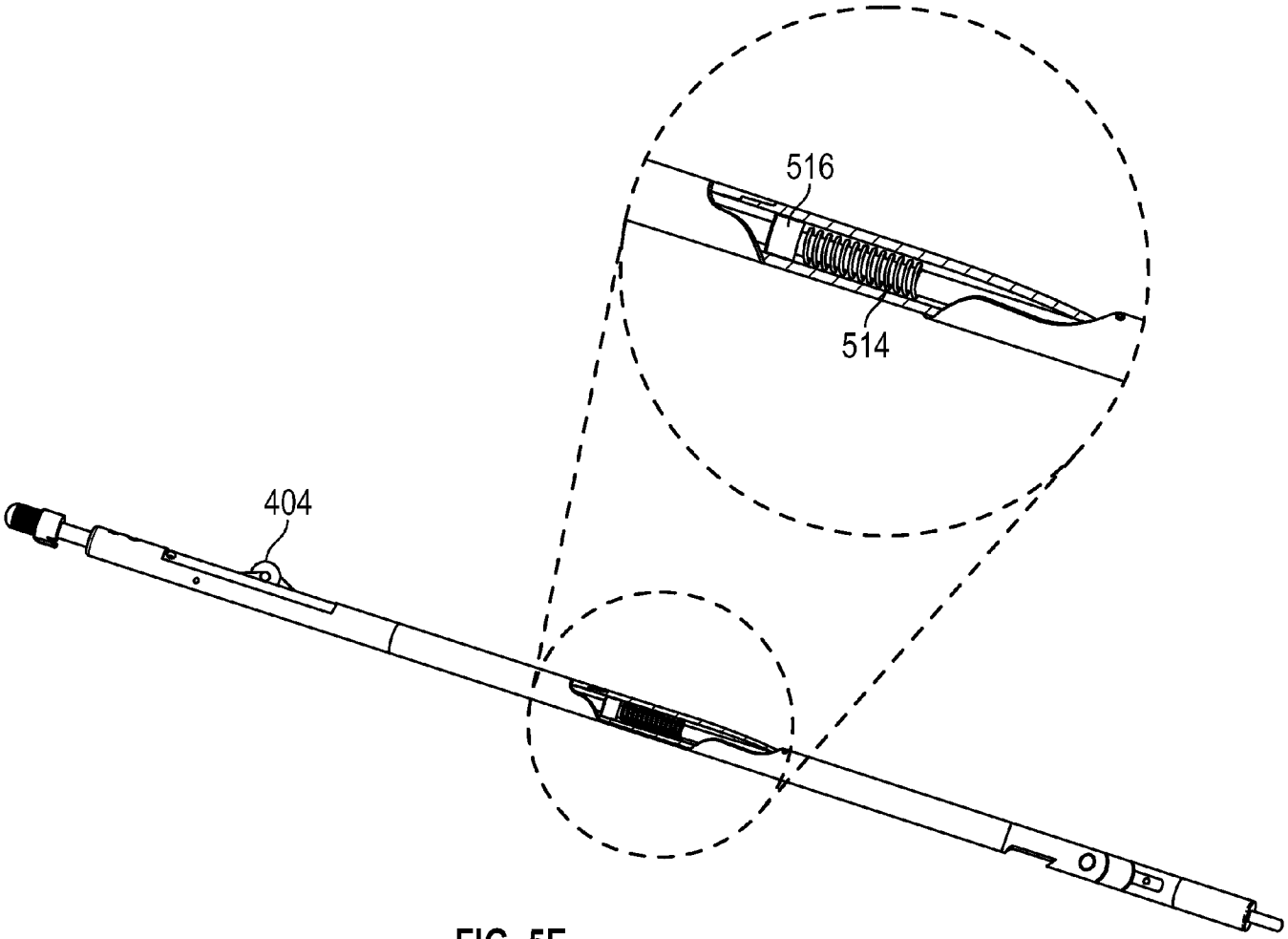

FIG. 5E illustrates one exemplary approach for adjusting the bias of the contact wheel 404. In the embodiment of FIG. 5E, an external bias spring 514 and a rotatable collar 516 are provided. The external bias spring tends to exert a force on the contact wheel mechanism previously described to bias the contact wheel 404 away from the main body of the device. By adjusting the force provided by the external spring 514, a user could increase or decrease the amount of bias force provided to the contact wheel 404 and, therefore, the pressure with which the wheel 404 will contact the inner diameter of the stator bore under inspection. The bias force provided by the external spring may be adjusted in at least two ways. In one way, external spring 514 can be selected to provide the desired bias force and, if a different bias force is required, the originally used spring can be removed and replace. In an alternative way, a single bias spring can be used and the collar 516 can be adjusted to compress or decompress the spring 514 and, therefore, adjust the bias force provided by the spring. Further alternative ways of adjusting the spring force are envisioned including an approach where multiple replacable springs are used alone, or in conjunction with an adjustment mechanism like collar 516.

In the illustrated example, the internal spring within the sensor element 510 in combination with the kick spring 512 cause the contact wheel 404 to exert a compressive force against the inner surface of the stator bore when the contact wheel is in contact with the inner surface. In one preferred embodiment, the sensor spring and the kick spring are configured such that the maximum force provided by the contact wheel 404 against the inner stator bore surface is below the level that would potentially deform the stator bore permanently. The precise level of force required to deform the inner stator bore may vary depending on the material used to form the bore. In one preferred embodiment useful with stator boar materials, the assembly is configured such that the maximum compressive force applied to the inner stator bore of the stator by the contact wheel is 0.3 pounds or less.

Figure 5F:
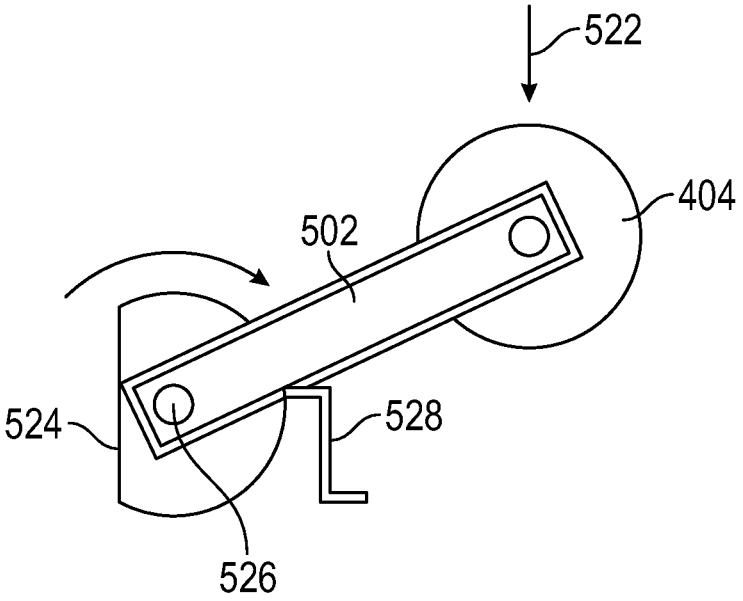

FIG. 5F illustrates another of the many possible embodiments of the present invention in which an angular displacement sensor 524 is used rather than the linear displacement sensor 510 of the previous embodiments. FIG. 5F illustrates contact wheel 404 rotatably coupled to the end of an arm or support 502 which is operatively coupled to angular sensor 524, such as by pin or transfer shaft 526. It will be understood that as the wheel rotates about pin 526 (i.e., translates generally in the Y-axis direction 522), the angular sensor converts such movement into a signal representative of Y-axis displacement. Also, illustrated I FIG. 5F is biasing element 528, such as a spring, that is configured to bias the contact wheel to its outermost position, as discussed above with respect to the linear sensor embodiments. Alternately, the angular sensor 524 may have a biasing element integral with the sensor body.

As reflected in the figures, a wheelhouse cover 512 may be provided to cover and protect the internal elements of the wheelhouse assembly 322 and to control the movement of the contact wheel 404 and the first and second members 502 and 504. The control of the movement of the contact wheel can be beneficial in that minimizing the amount of travel of the contact wheel 404 can improve accuracy.

In some embodiments, only the minimum internal diameter of the stator bore may be measured. In such embodiments, the cover 512 may cooperate with the contact wheel 404 and the first and second members 502 and 504 to allow the contact wheel to contact the stator interior when the contact wheel is at or near a stator bore minimum, but to not contact the stator bore interior at other times. In such embodiments, the movement of the contact wheel may be such that the maximum travel of the contact wheel from its point of maximum distance along the Y-axis from the end assembly 322 to the minimum distance along the same axis is about 0.200 inches.

One advantage of using a contact wheel 404 and associated members, like members 502 and 504 is that they allow the device to take independent measurements of each of a plurality of minimum interior diameters of the stator bore by merely moving the contact wheel assembly 404 across the interior bore. This is because the contact wheel is sized such that the point of contact between the contact wheel and the interior of the stator bore is, in terms of distance along the X-axis, only a small percentage of the total distance of a typical stator lobe. This allows the device described herein to take individual measurements of individual lobes as the device is pulled through a stator bore. In one embodiment, the contact wheel 404 and associated members permit accurate measurements at a resolution of approximately $3/1000$ of an inch or less. In another embodiments, measurements can be taken are a resolution of $1/10{,}000$ of an inch. These resolutions are substantially less than the dimensions of a typical lobe in a stator bore.

A further advantage of using a contact wheel 404 and members that can translate movement of the contact wheel into movement of a transfer shaft, like shaft 406 or 526, is that it allows for the fast and efficient taking of measurements. Instead of moving a probe to discrete locations along the stator bore and activating the probe at those discrete locations, the contact wheel can be moved across the stator bore interior and measurements can be continuously taken as the contact wheel traverses the stator interior. As discussed previously, these continuous measurements may be recorded to one or more memory systems associated with the apparatus 300, or may be transmitted (wired or wirelessly) to a remote recording system.

The middle assembly 320 may be coupled to the end assembly in any suitable manner. Because it may be beneficial to decouple the middle assembly from the end assembly to allow for inspection, maintenance and replacement of the sensor 510 within the end assembly, embodiments are envisioned where the coupling is such as to allow for easy separation of the middle assembly 320 form the end assembly 318. Such an embodiment is reflected in FIG. 5B. As reflected in the figure, in the illustrated embodiment the middle assembly 320 (shown transparently) includes a male projection that extends into a cavity in the end assembly 318 (also shown transparently). A groove 520 is formed in the male member and one or more screws are passed through openings in the end member 318 to engage the groove and hold the middle assembly 320 and the end assembly 318 together.

In the embodiment of FIG. 5B, the tension of the coupling screws can be such as to either hold the middle assembly 320 in a fixed relationship with respect to the end assembly 318, such that there is no relative movement between the two assemblies, or can be set to allow full or restricted rotational movement between the two assemblies (e.g., movement about the Z axis, but not along the X axis). Such an embodiment may be desirable in applications where movement of the handle in a rotational manner is expected. Allowing some rotational movement between the middle assembly 320 and the end assembly 318 may tend to dampen any rotational movement of the handle as it progresses towards the contact wheel 404 and minimize the impact of such rotational movement of the handle element 310 on the measurements taken by the centering wheel.

Figure 6A:
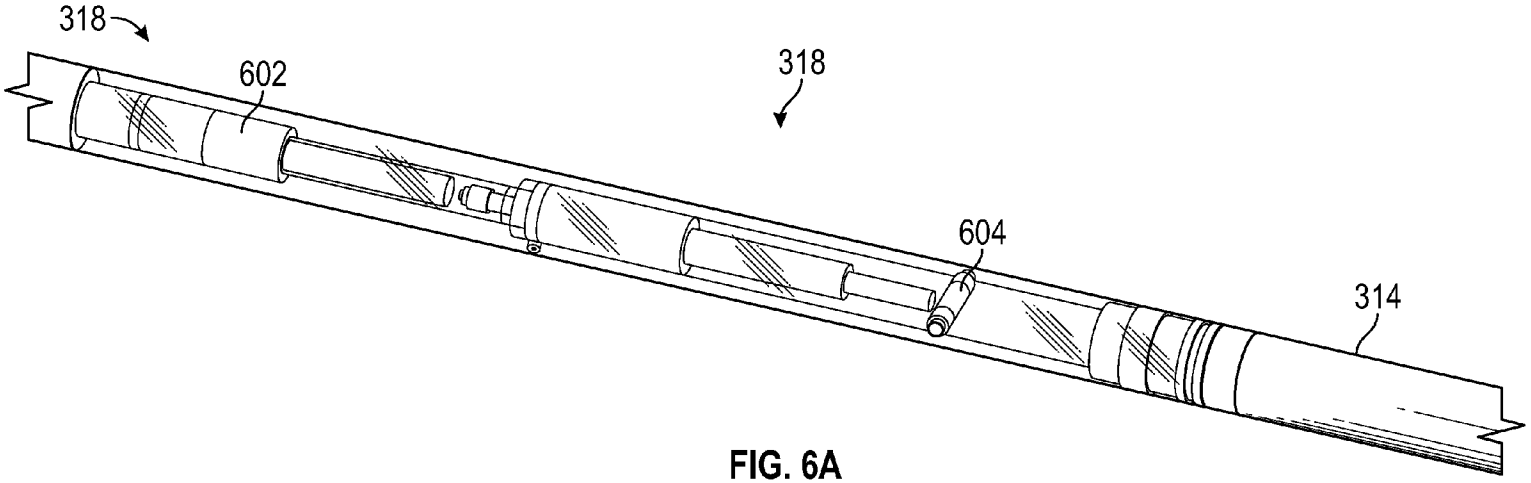
FIGS. 6A and 6B illustrate representative features of an end section of a stator bore gage constructed in accordance with various teachings herein.
Figure 6B:
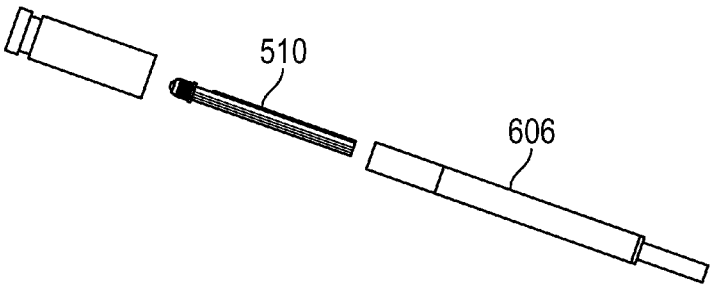

Details of the end assembly are shown in FIGS. 6A and 6B. For purposes of illustration, the main housing 602 of the end assembly is shown transparently.

Referring to FIGS. 6A and 6B, the end assembly includes a positioning pin or dowel 604 that is located at a fixed position within the end assembly 318. Resting against the positioning pin 604 is the end of a positioning element 606 that includes a shaft that rests against the positioning pin 604 and an open socket on the other end. Positioned within the open socket of the positioning element 606 is a linear probe 608 with a movable tip. The liner probe 608 may be any probe that can convert movement along one axis into a digital or electronic signal. In one embodiment, the probe 608 may be the #DK812SBR5 probe, available from Magnescale Americas, Inc., which has a 12 mm stroke, a 0.5 micrometer resolution and strait 100 m/min response speed.

The end assembly may also comprise one or more temperature sensors configured to transduce the actual environmental temperature of the end assembly into a signal (electrical or optical) that can be used by the electronics associated with the apparatus (e.g., the electronic circuits in the handle). Suitable temperature sensors include, but are not limited to, thermocouple sensors, resistive temperature devices (RTDs); infrared sensors; thermistors; silicon bandgap temperature sensors; or combinations thereof. Temperature measurements can be, but are not required to be, continuously recorded directly or indirectly against the measurement data. It will be appreciated that the operational temperature of the end assembly may be used to correct or calibrate the measurement data in real-time or after the fact.

The end assembly may also comprise one or more cameras or other visual sensors configured to "see" the area of the stator actually being measured, that has been measured or that will be measured. In one such embodiment, a real-time video camera signal is provided to the handle and a video transmission cable transfers the signal from the handle to a processing and/or display system. Alternately, the handle (as described herein) may comprise a visual display capable of showing the video captured by the end assembly. Still further, the video signal may be continuously recorded as described above for measurement data and temperature data. It will be appreciated that "still" shots can be captured in place of or in addition to video. It is contemplated that one embodiment of the apparatus 300 will capture snapshots of the stator bore on the occurrence of predefined events, such as minimum measurements, measurement "chatter" or other outlier or anomalous type measurements.

The end assembly 318 may be coupled to the handle tube 314 in any suitable manner. In one embodiment, the connection is such that it may permit relative movement in one more axis between the end assembly 318 and the handle tube 314. The allowance of such relative movement is beneficial because—if no such relative movement were permitted—movements of the handle assembly 310 by the operator (even subtle involuntary movements) could impact the measurements made by the detector assembly.

Figure 7A:
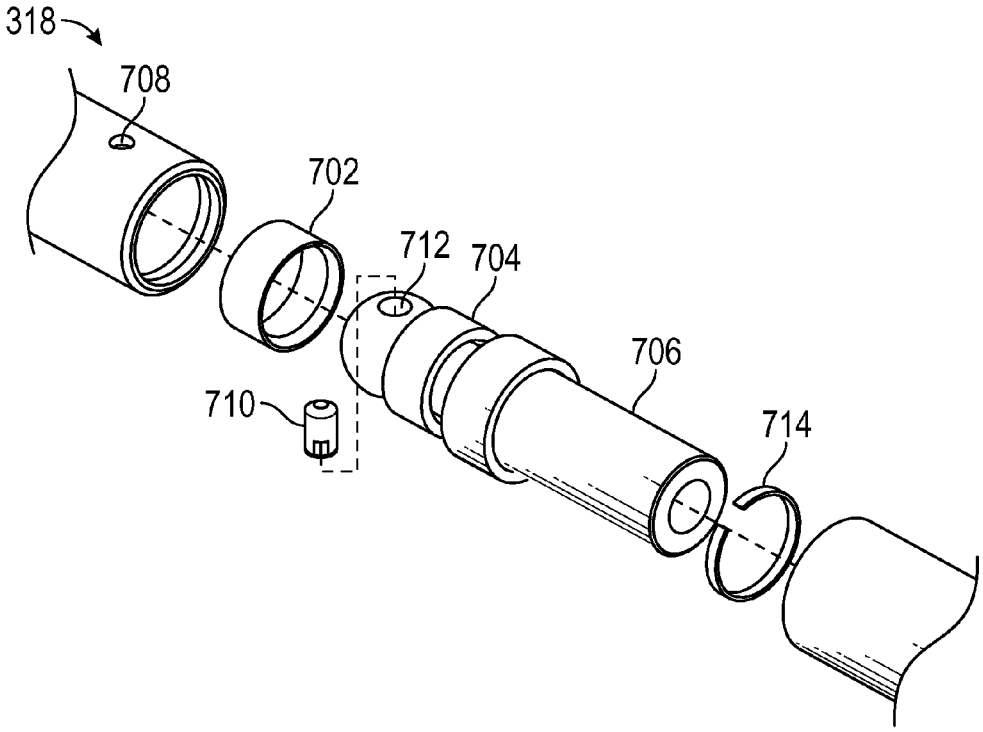
FIGS. 7A and 7B illustrate a coupling that can be beneficially used to couple an exemplary end section to a representative handle section in accordance with certain teachings herein.

FIG. 7A shows one exemplary coupling arrangement that couples the handle tube 314 to the end assembly 318 in such a manner that the handle tube 314 may move relative to the end assembly 318. Referring to FIG. 7A, the illustrated coupling includes a "ball-in-socket" assembly that includes two spherical washers 702 and 704, sized to fit within a receiving cavity in the end assembly 318. The two spherical washers 702 and 704 are positioned about a ball hinge element 706 that has one end coupled in a fixed relationship to the handle tube 314. In the illustrated example, the ball hinge element 706 defines one or more generally cylindrical voids and the end assembly 318 defines a threaded opening 708 capable of receiving a screw 710. In this example, the outer diameter of the screw 710 is less than the inner diameter of the cylindrical void 712 such that the ball hinge element 318—and therefore the tube handle 314—can move relative to the end assembly 318. In the illustrated embodiment, a split ring 714 fits within a groove of the end assembly 318 to hold the two assemblies together.

Figure 7B:
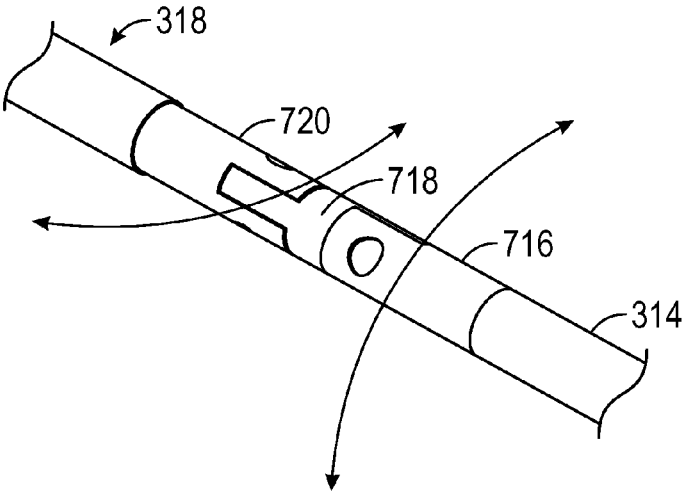

Other alternative coupling arrangements for allowing relative movement between the end assembly 318 and the handle tube 314. For example, embodiments are envisioned wherein a U-joint connection is used to provide the connection. FIG. 7B illustrates one such alternative connection. In the exemplary embodiment of FIG. 7B a U-joint connection is provided between the end assembly 318 and the handle tube 314. Referring to the figure, the illustrated U-joint connection includes a first element 716 coupled to the handle tube 314 and an intermediate element 718 coupled to the first element 716 such that the first element 716 can pivot with respect to the intermediate element 718 about a first axis. The illustrated connection also includes a second element 720 coupled to the intermediate element 718. The second element 718 is coupled to the end assembly 318. The second element 720 is coupled to the intermediate element 718 in such a way that the second element 720 can pivot with respect to the intermediate element 718 along a second axis. In the illustrated embodiment, the second axis is perpendicular to the first axis.

Still further alternate couplings for connecting the handle end 314 to the end assembly 318 are envisioned. For example, only one of the pivoting connections reflected in FIG. 7B could be used.

For certain, sizes of stator bores, an apparatus as generally illustrated in FIGS. 3A and 3B may be used to inspect the stator bore interior. For larger bores, an expansion shoe may be used with the described apparatus. One of the purposes of the use of an expansion device is to ensure that the contact wheel is properly positioned with the respect to the interior of the stator bore to be measured. In general, the contact wheel should be positioned such that the maximum deflection of the contact wheel is relatively low and on the order of less than 1/10 of an inch. In one preferred embodiment, the contact wheel and associated structures are such that the maximum deflection of the wheel is on the order of 75/1000 of an inch.

Figure 8A:
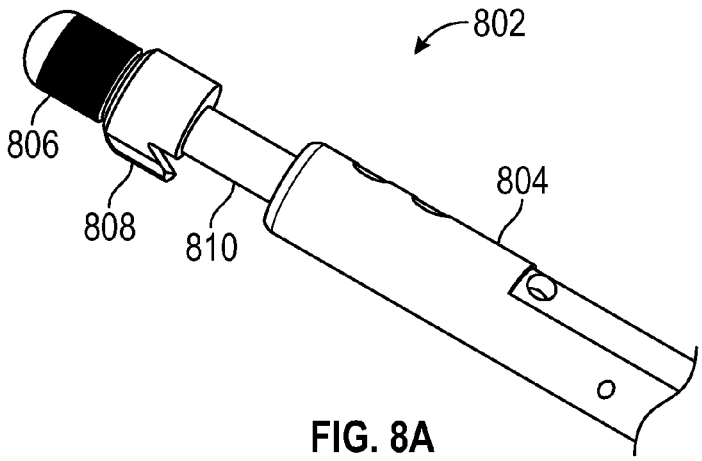
FIGS. 8A-8G illustrate various forms of extension devices and a brace that may be used with one embodiment of a stator bore gage described herein to facilitate use of the gage with motor stator bores of varying sizes.

FIG. 8A illustrates a nose assembly 802 that can be used to allow for efficient coupling between expansion shoes of varying sizes and the apparatus 300.

Referring to FIG. 8A a nose assembly 802 is coupled to the end of the wheelhouse assembly 322 via a screw element 804 that is received into the wheelhouse assembly. The nose assembly 802 includes a screw nose 806, a drive nut 808 and a location dowel 810 having ends projecting from each side of the drive nut. By turning the screw nose, the drive nut may be moved forward and backward along the elongated axis of the wheelhouse assembly 322, thus causing the location dowel 810 to move relative to the wheelhouse assembly. Not shown in FIG. 8A is a second location dowel 812 positioned at a fixed location on the end assembly 318.

Figure 8B:
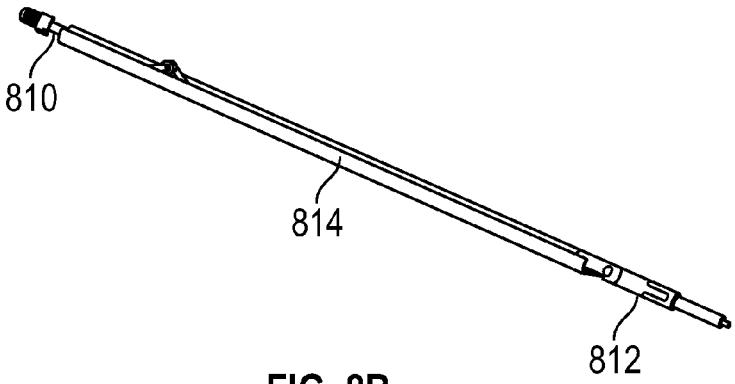

FIG. 8B illustrates a first expansion shoe type 814 that may be used to permit use of the apparatus 300 with stator bores having relatively small diameters. The shoe 814 is a tubular element that has prong-like openings at each end that are sized to receive the location dowels 810 and 812. In use, the shoe 814 is slid over the detector assembly at a time prior to the attachment of the nose assembly 802. One of the pronged ends is then connected to the location dowel on the end assembly 318 and the nose assembly 802 is then attached to the wheelhouse assembly 322. Through adjustment of the screw nose 806, the drive nut 810, and thus the location dowel 810, are moved inward towards the shoes 814, until the dowel 810 engages the prong end of the shoe 810 and holds it in place. Alternatively, the nose assembly can define a conical element that is driving into the interior bore of the shoe to hold it in place.

Figure 8C:
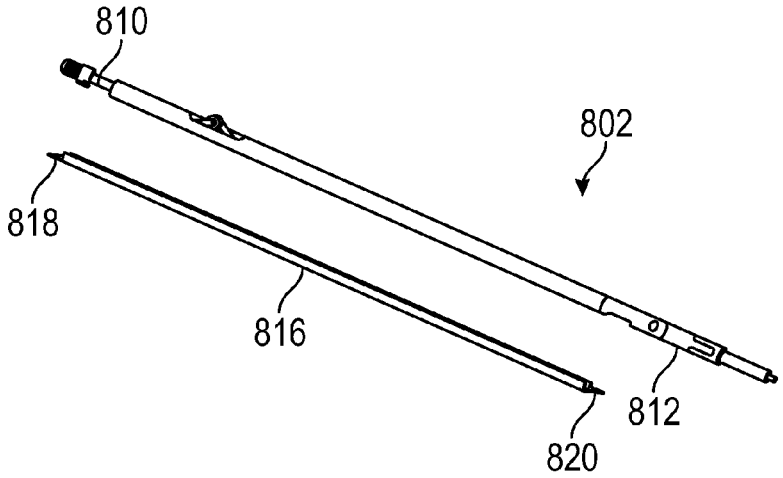

FIG. 8C illustrates yet another embodiment of an expansion shoe that may be used with apparatus 300. The illustrated expansion shoe 816 is a slide on expansion shoe that can be used with stator bores having relatively mid-sized diameters. As reflected in the figure, the expansion shoe 816 defines receiving sections 818 and 820 sized to receive the location dowels 810 and 812. In use, the shoe 816 is slid onto the apparatus such that the receiving sections 88*a* and 88*b* generally receive the location dowels or wedge 810 and 812. The nose assembly is then adjusted, by moving the dowel 810 away from shoe 816, until the shoe is held firmly in place with respect to the detector assembly. In situations where large diameter stator bores are to be inspected, or in situations where additional support is required, a brace bar may be attached between the handle element 310 and the handle tube 314.

In general, the shoes and/or bars should be sized to ensure that the gap between the outer surface of the device opposite the shoes and the optimal stator bore minimum dimension is less than some pre-determined amount, which in one embodiment is 50/1000 of an inch. Providing such small clearances tends to ensure that the device is properly aligned when inserted into the stator bore and during any pulling of the device through the stator bore. This alignment approach ensures that the measurements taken by the device when pulled through a stator bore are consistent between users and repeatable between different measurements taken by the same user. For example, in instances where the device/shoes are sized to ensure that the maximum distance as described above is 50/10000 of an inch or less, the measurements can be expected to repeat within a 3/1000 to 5/1000 tolerance level.

In situations as described above, where the service and shoes are sized to ensure that the distance to the optimal minimal inner bore diameter is less than a predetermined amount, a measurement indicating that the distance is above that amount may indicate or suggest wear or another issue with the stator bore under inspection, such that a measurement above that range may result in the bore under inspection failing the inspection.

Figure 8D:
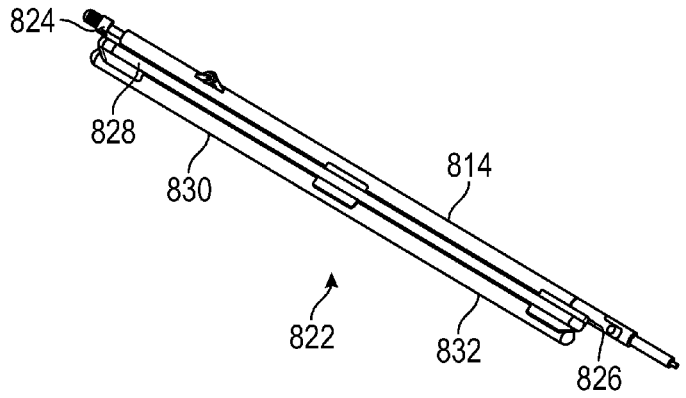

FIG. 8D illustrates yet another shoe design, this one for use with stator bores having a relatively large diameter. The illustrated shoe 822 includes mounting plates (824 and 826) which include receiving sections similar to those described above with respect to FIG. 8C. Coupled to the mounting plates are multiple shoe rods 828, 830 and 832 designed to position the shoe within the stator bore. To minimize weight, the she rods 828, 830 and 832 may be made of carbon fiber.

Figure 8E:
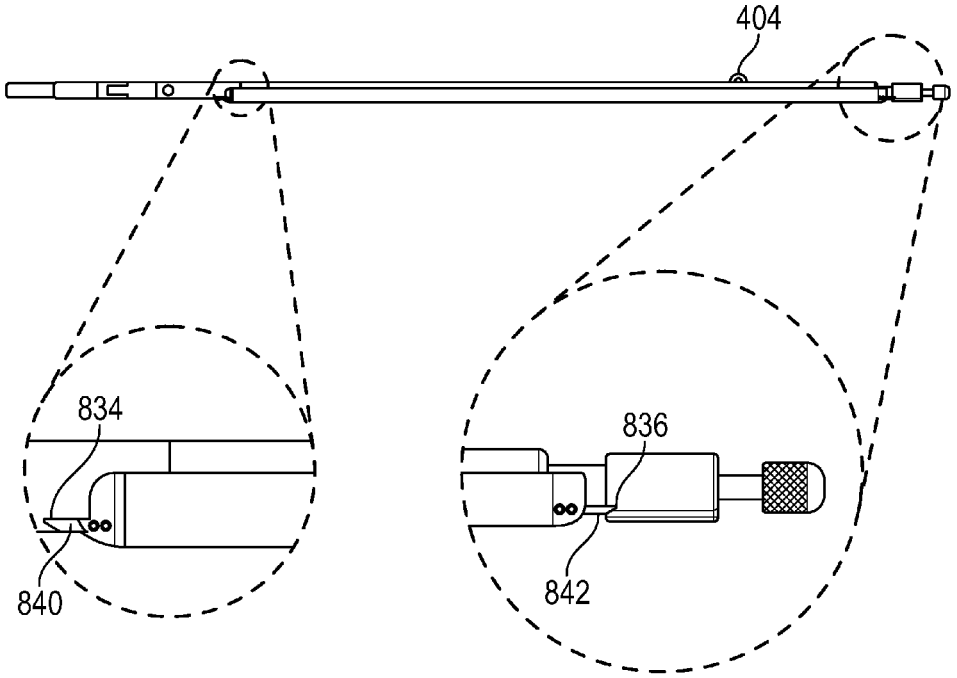

FIG. 8E illustrates an alternate approach for attaching shoes to the detector assembly. In this alternate approach, portions of the detector assembly define notches like notches 834 and 836. The shoes are fitting with projecting members 840, 842 that are shaped to fit into the notches or wedge. In operation, the shoe is brought into a desired position and the nose assembly is then adjusted to hold the shoe in place.

Figure 2:
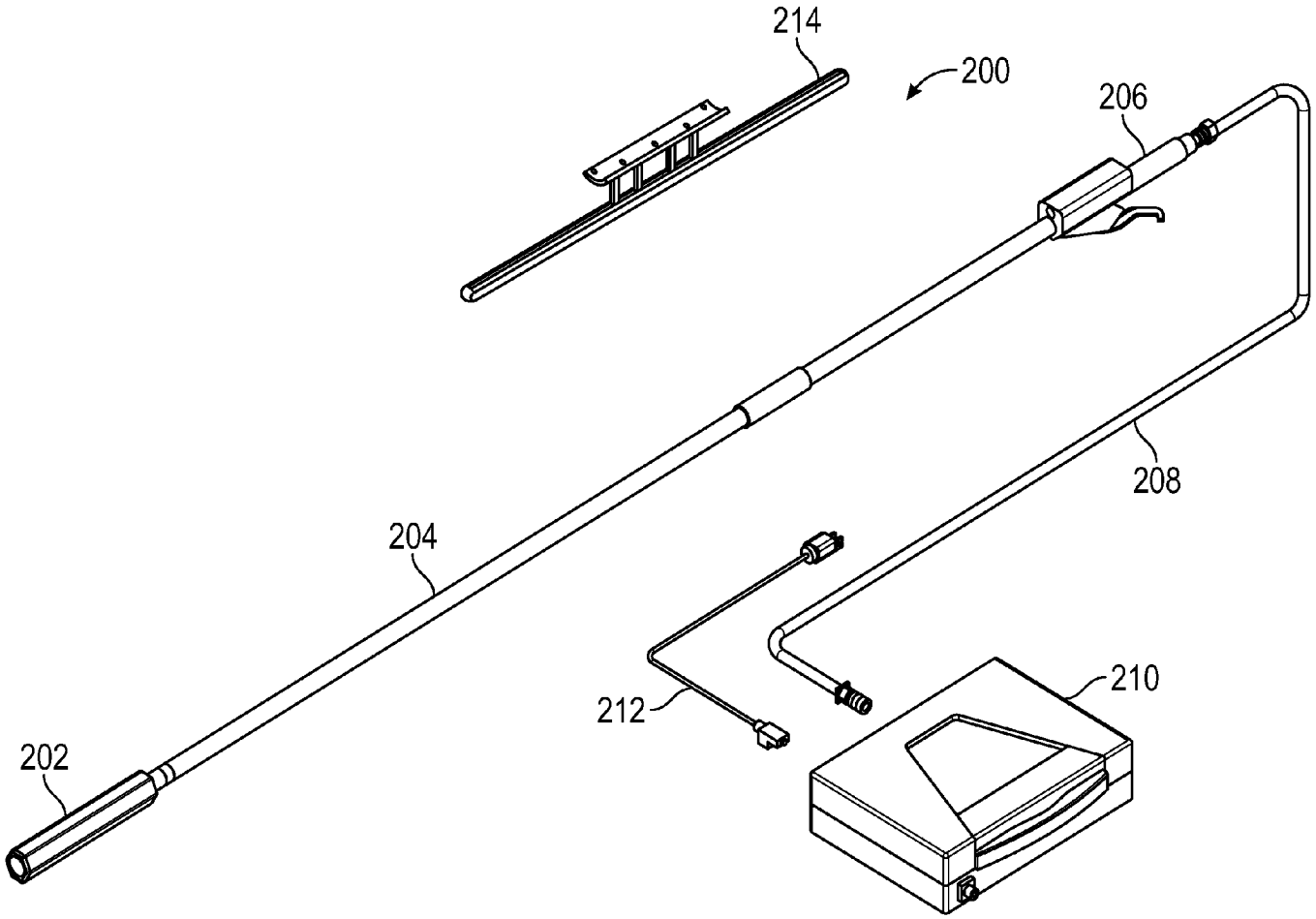
FIG. 2 (Prior Art)
FIG. 2 illustrates a prior art mud motor stator bore gage.
Figure 8F:
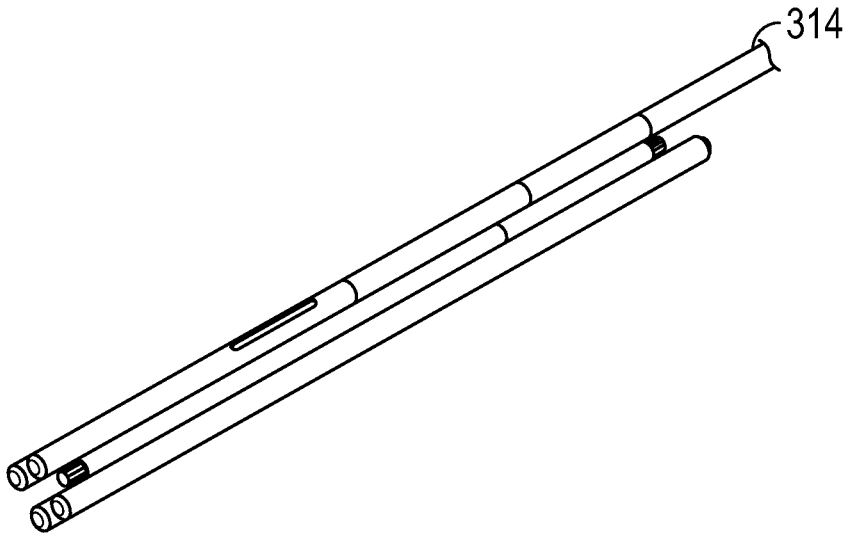
Figure 8G:
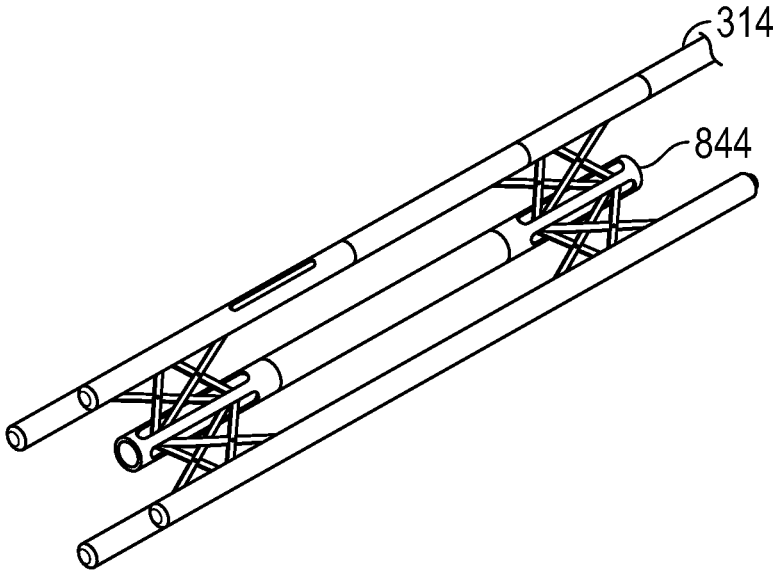

FIGS. 8F-1 and 8F-2 illustrate a further embodiment that may be used to permit inspection of bores of varying sized without using attachment shoes. In this embodiment, a scissor-like assembly 844 is attached to the detection assembly that is coupled to the handle tube 314. The scissor assembly includes a central member and multiple rods (four in the example) that are attached to the central member via scissor connectors. The scissor connectors may be adjusted, though fixed settings, manipulation of an element (e.g. a screw) within the central member or any other suitable method to expand to the size necessary for proper inspection of a large variety of stator bores.

In preferred designs, the diameters of the shoe or shoes are carefully selected to closely correspond to the ideal maximum internal diameter of the stator bore to be inspected. The close matching of the shoe/shoes outer diameters and the stator ideal interior diameter tends to ensure that the detector assembly is always in proper axial alignment. This allows the operator to use the disclosed device by simply inserting the device into a stator to be inspected and dragging the device through the stator bore without any twisting or rotating of the device. This ability of the described device to permit proper inspection with no twisting or rotation of the device and with no to minimal effort of the user to ensure proper axial alignment ensures both inspections that are more accurate and more time-efficient. It also ensures proper measurement and consistency between different operators or the same operator at different times.

In situations where large diameter stator bores are to be inspected, or in situations where additional support is required to support a shoe or another apparatus used to allow the device described herein to be used with bores of different size, a brace bar may be attached between the handle element 310 and the handle tube 314. FIG. 8D illustrates the use of a brace bar 814.

It should be appreciated that the described embodiment of the apparatus 300 is only one possible embodiment of the subject matter disclosed and claimed herein and that other designs are possible. For example, the detector assembly was illustrated and described as having three sections—the wheelhouse assembly 322, the middle assembly 320 and the end assembly 318. The detector could be constructed as a single element or as an element having more sections than those described above. Further, in certain embodiments different forms of sensing devices could be used. As one example, in the described sensor, the contact wheel moves in the Y direction and the sensor moves in the X direction. Embodiments are envisioned where the sensor is aligned with a contact wheel (other movable element) such that both the movable element and the sensor move in the Y direction and there is no need to translate the movement of the movable member in one direction into movement of a sensor in another direction. Still further, other methods and approaches could be used for coupling a handle tube to the end assembly of a detector (or to a unitary detector assembly) and embodiments are envisioned wherein the handle tube is unitary with the detector assembly. As a still further example, embodiments are envisioned wherein there is no handle or handle tube, and where the device apparatus are coupled to a sensor element by one or more wires and where the detector assembly is pulled through the stator bore to be inspected by a connecting wire. This embodiment could be used where a compact apparatus is required and/or where the length of the stator bore to be inspected is such that it would be difficult to have a handle tube of suitable length.

Based on the embodiment described above, it will be appreciated that all or some of the electronics described above may be located on the detector assembly itself and not on a handle. Still further, some of the electronics, such as data acquisition system and data transmission systems (wired or wireless), can be location on the detector assembly, other electronics, such as processing electronics, can be located remotely In still alternative embodiment, a housing containing an optical element and a laser or focused light source could be used to detect the outer profile of the stator bore under inspection.

Alternate approaches can be used to provide communications between the described device and a man-machine interface. In one embodiment, a Bluetooth link can be created between the described device and a programmed personal computer or tablet computer. In alternative embodiments, a wired link may be used. Other embodiments are envisioned wherein the device does not provide any instantly readable output, but rather stores data on a memory device (e.g., an SD memory card) that could later be read by another device (e.g., a remote computer) to access stored data on the memory device.

Figure 9A:
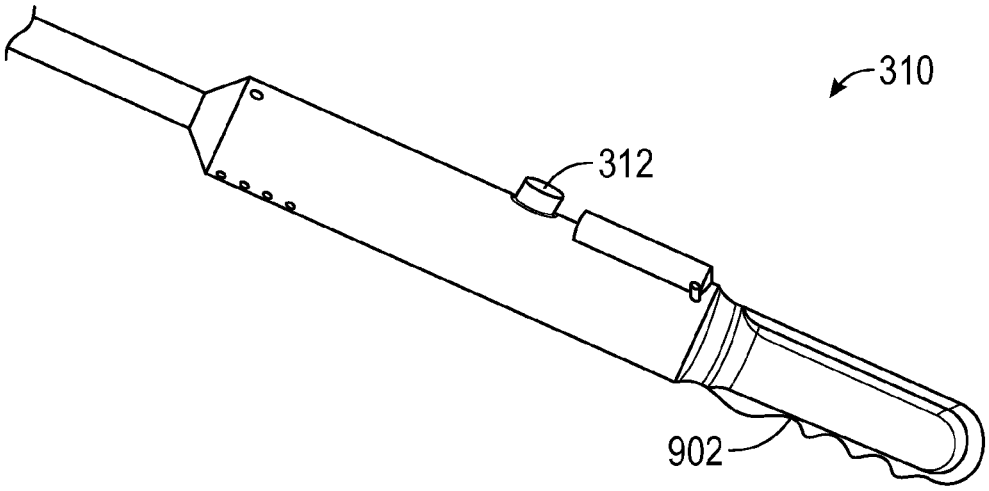
FIG. 9A illustrates an exemplary form for one embodiment of a handle assembly in accordance with teachings herein.

FIG. 9 illustrates the handle assembly 310 in greater detail. As previously described, the handle assembly includes a body that can be sized to include the electronics used with the apparatus and a battery to power the electronics and can provide a handhold for the user. In the embodiment illustrated in FIG. 9, the handheld device 310 includes a power button 32 for powering the device on and off and a trigger button 902 that may be depressed to cause the apparatus 300 to begin to take measurement readings.

The described apparatus can be used in a variety of ways to inspect the interior bore dimensions of a mud motor stator In accordance with one exemplary preferred method, the process of using the system may involve an initial characterization step where the precise relationship between Y movement of the contact wheel and X movement of the transfer shaft (and therefore the transfer shaft) is characterized through actual measurements associated with a specific device and the characterized data is then stored in the electronics of that device.

As noted above, the relationship between Y movement of the contact wheel and X movement of the transfer shaft (and therefore the sensor) is not linear and may vary depending on the position of the contact wheel and the transfer shaft. Moreover, the precise relationship between the Y movement of the contact wheel and the transfer shaft (sensor) can vary subtly from device-to-device due to manufacturing tolerances. To account for this fact, each device constructed in accordance with the teachings herein may be characterized after assembly by taking actual X vs. Y position readings for several positions of the contact wheel. These position measurements, along with some extrapolation techniques, can be used to create a specific X vs. Y curve for the specific unit and that curve can be used to accurately translate a specific X reading from the sensor to a specific Y position of the contact wheel.

Because the physical characteristics of a given device are not anticipated to change appreciably over the life of the device, the characterization step need likely be taken only once for each device. However, as the device suffers wear or if the device is modified or components of the device are modified or replaced (e.g., if the sensor is replaced) an additional characterization step may be required or desired.

Figure 9B:
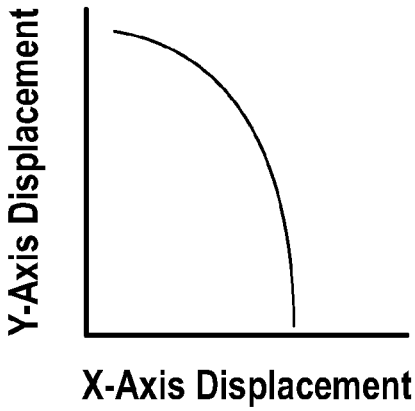
FIG. 9B illustrates an exemplary calibration curve for a linear sensor embodiment.

In situations where each device is not characterized, a representative X vs. Y characterization curve can be used or pre-programmed or pre-stored in the device. FIG. 9B illustrates an exemplary contact wheel displacement versus X-axis displacement curve for an embodiment of the invention utilizing a linear sensor 510. As this figure illustrates, the relationship between contact wheel 404 movement and displacement long the X-axis 520, for example, displacement of the transfer shaft 406, is nonlinear. In this type of X vs. Y relationship, the early part of the curve may exhibit greater sensitivity than later parts of the curve. This nonlinear behavior and varying sensitivity may be taken into account when designing a stator bore gage utilizing one or more aspects of the inventions disclosed herein. For example, and without limitation, a shoe or sled used with the gage may be sized such that the expected minimum diameter of the stator bore occurs in the region of high sensitivity.

Once the described apparatus is characterized, or an X vs. Y curve is otherwise stored or programmed into the device, the device can be placed into field use. In field use, the device may be used in accordance with a method that may typically involve the steps of: (1) identifying the desired size of the stator(s) to be inspected; (2) determine whether any expansion shoes are required for the inspection and, if so, selecting and installing the appropriate; (3) identifying the appropriate setting standard associated with the stator to be inspected; (4) calibrating the assembly 20 using the selected setting standard and then (5) inspecting one or more stator bores of the same desired size using the calibrated apparatus. The process may be facilitated by use of the man-machine-interface, which, in the illustrated example is an Android-based smart phone.

FIGS. 10A-10H illustrate screen-shots from a representative man-machine interface in the form of a laptop computer coupled to the device 300 via wired or a wireless link that are helpful in describing a process for using the device described herein.

Figure 10A:
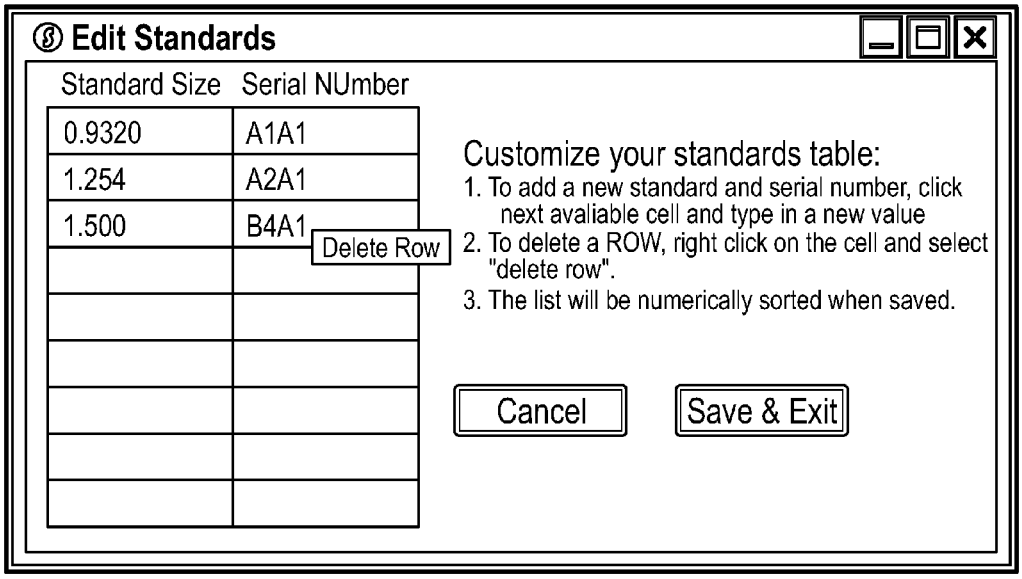

Initially, in FIG. 10A, standard devices are associated with specific desired bore hole sizes with each standard being assigned a specific serial number. The standards should be manufactured with tight tolerances such that the inner diameter of the standard very closely matches the standard size associated with that standard.

Figure 10B:
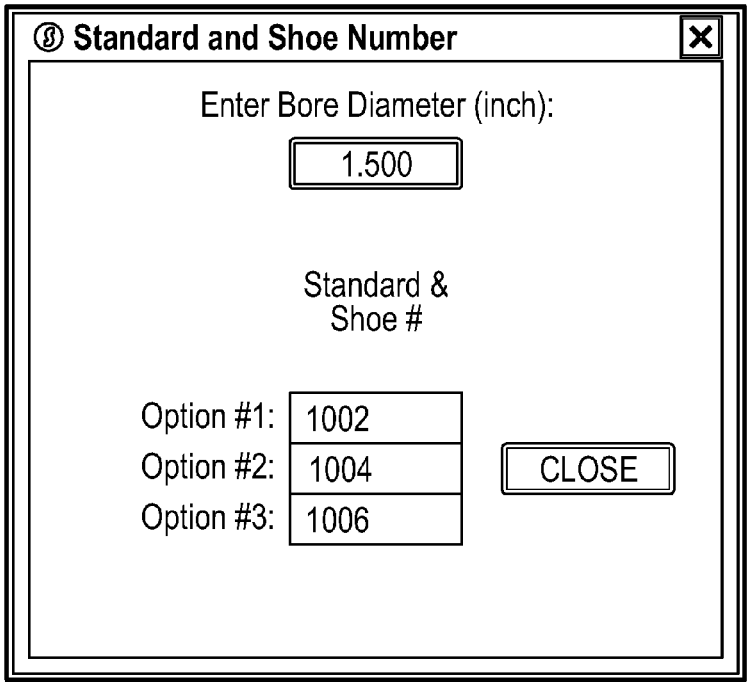

Once the desired standards are associated with the various bore diameters to be inspected, a user can enter a desired bore diameter into the man machine interface and be provided with an indication of which standard to use. This is shown in FIG. 10B where the user enters into the man machine interface the optimal bore diameter for the device to be inspected (in the example 1.500 inches) and the man machine interface provides an indication of the standard (or standards) that can be used for the inspection. In the illustrated example, the standards labeled 1002, 1004 and 1006 are associated with the entered bore diameter and may be used for purposes of the inspection. In this step, the man machine interface may also indicate whether any shoe attachments should be used and, if so, what shoes should be used.

Figure 10C:
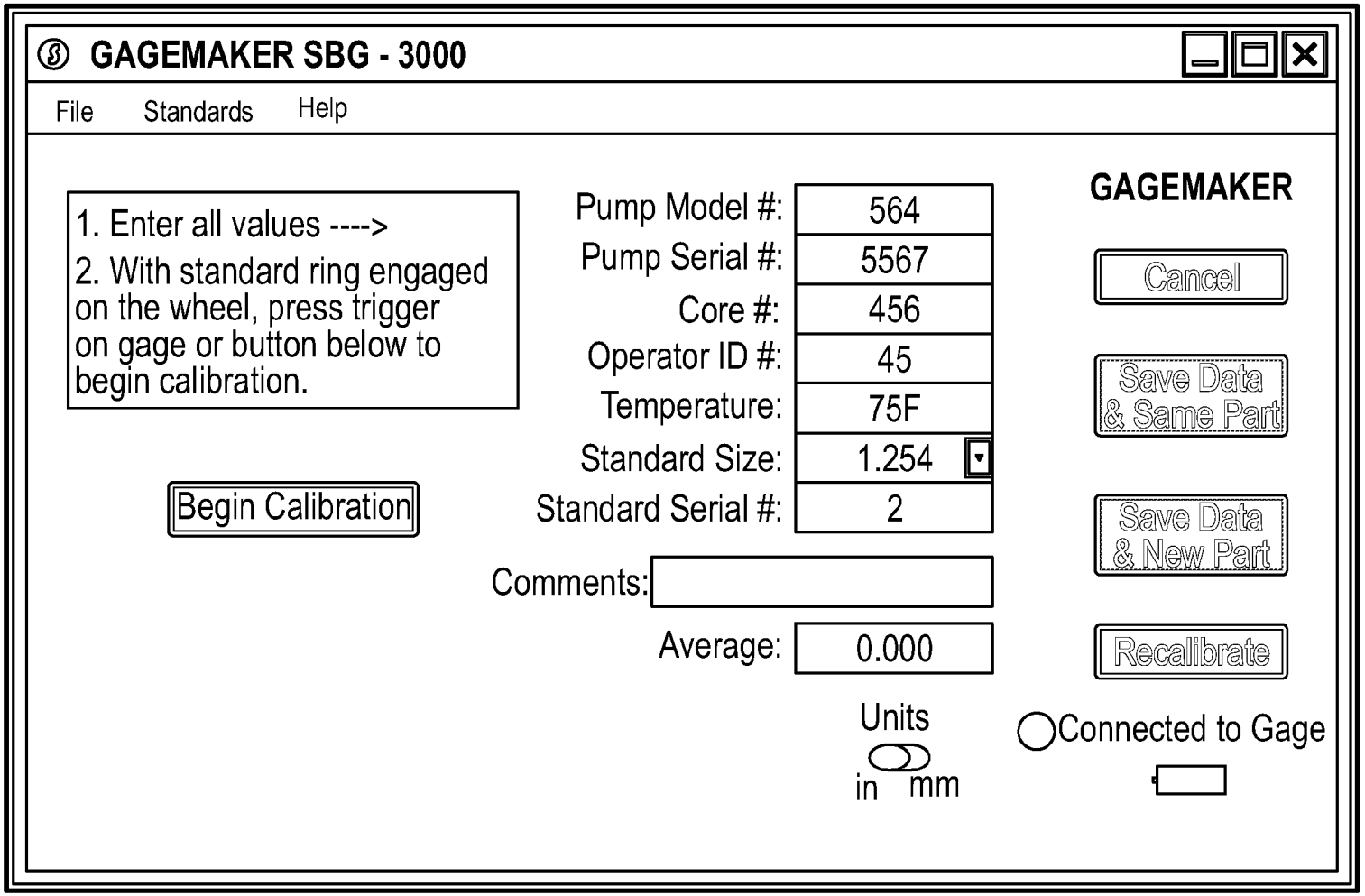
Figure 10D:
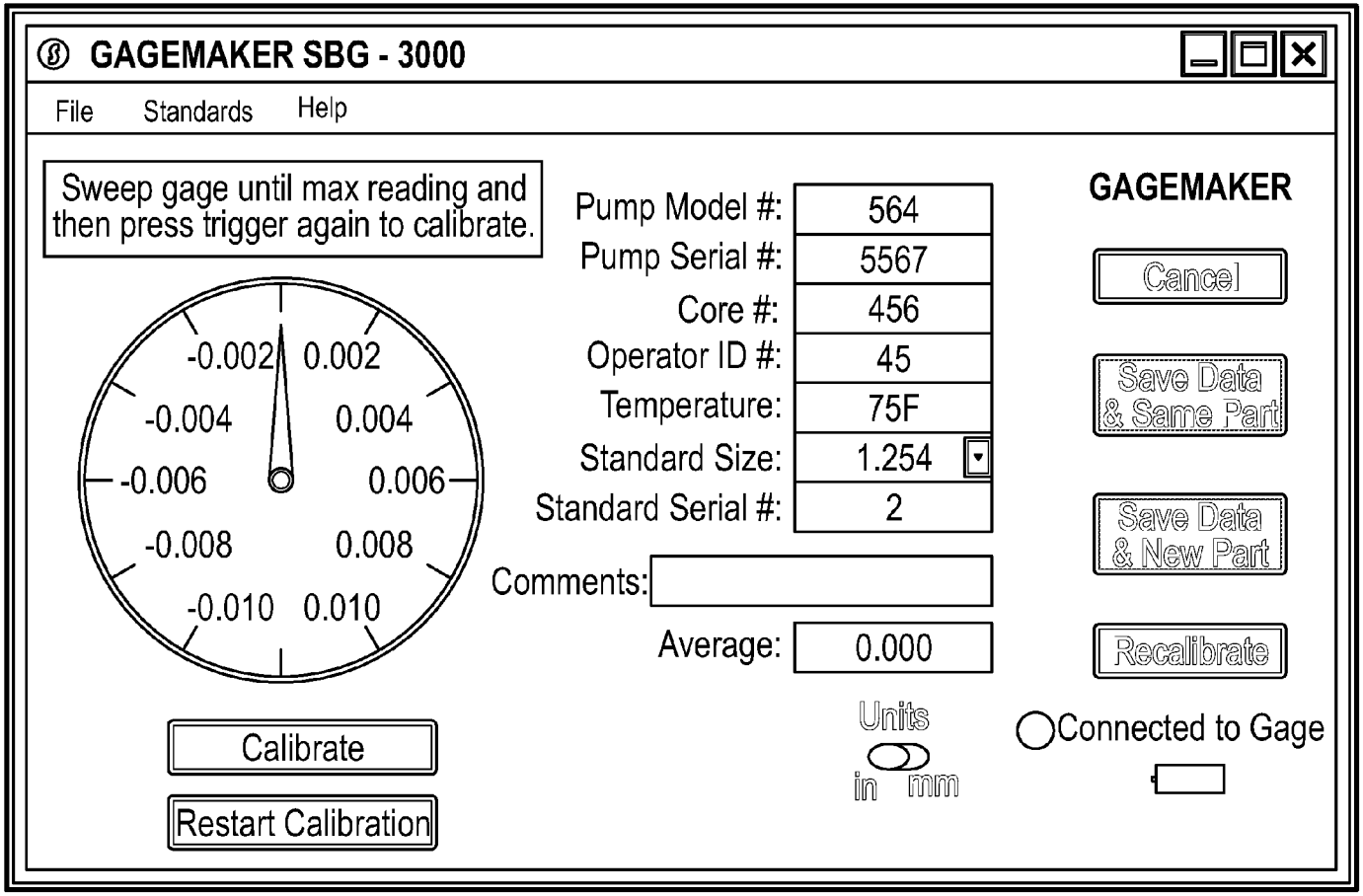

Following the selection of the proper standard, the stator bore gauge should be calibrated. The calibration process is initially shown in FIG. 10C. Referring to FIG. 10C, the man machine interface initially asks the operator to enter data about the particular pump/motor to be inspected, about the operator, and about the temperature. Once this data is entered, the user is promoted to move the gauge through the standard until a max reading, corresponding to the maximum internal diameter of the standard, is detected. This is shown in FIGS. 10D and 10E.

Once the device is calibrated (e.g., FIG. 9B, the detecting portion of the device (e.g., the portion with the contact wheel) and any shoes are inserted into the stator bore to be inspected. The device is then triggered and the user pulls the device through the bore. The device may then take measurements and record the various maximums readings (or alternatively, the various minimums). This is shown in FIGS. 10F and 10G. These readings are then output to a readable file as shown in FIG. 10H.

Figure 10E:
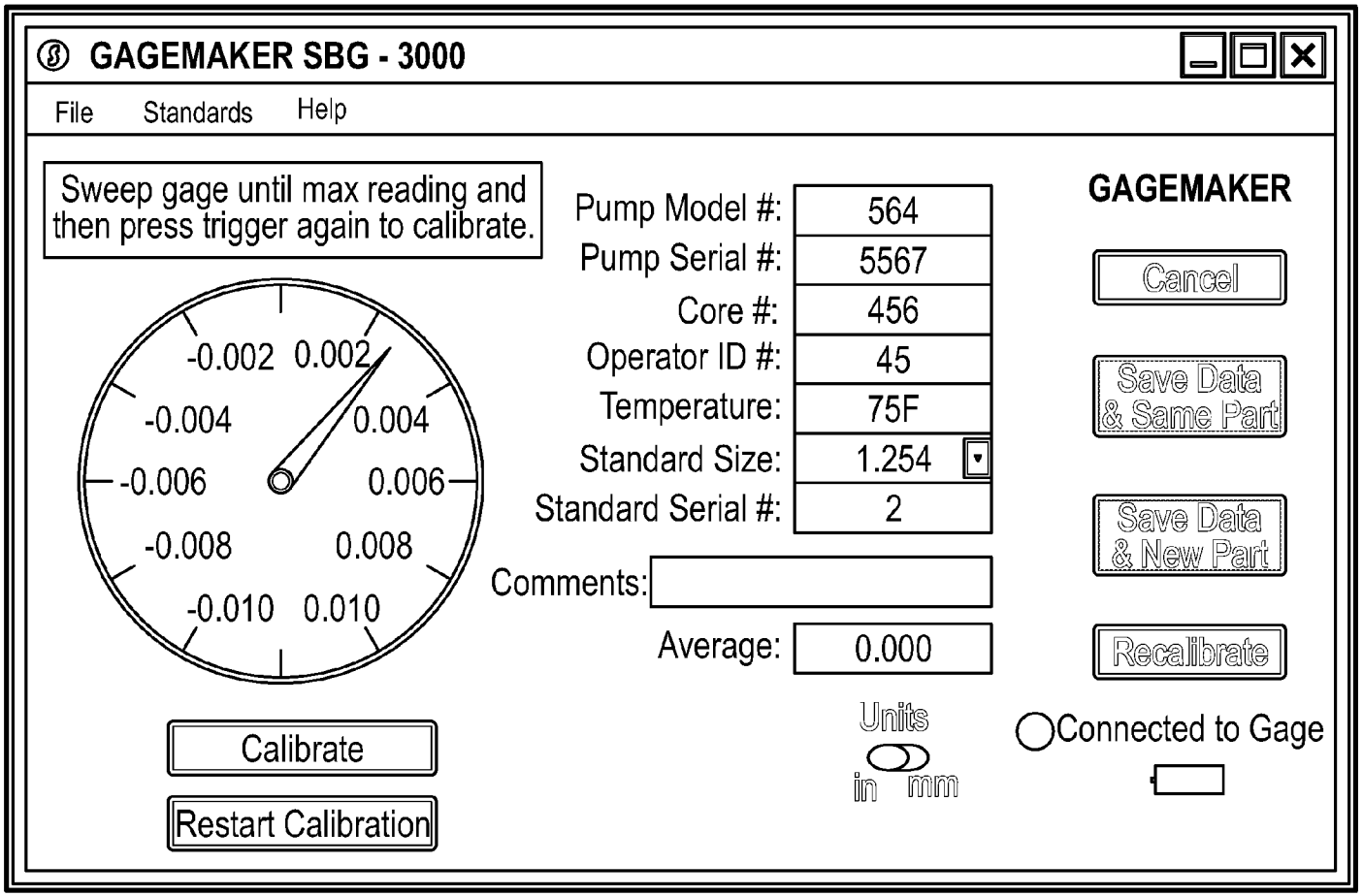
Figure 10F:
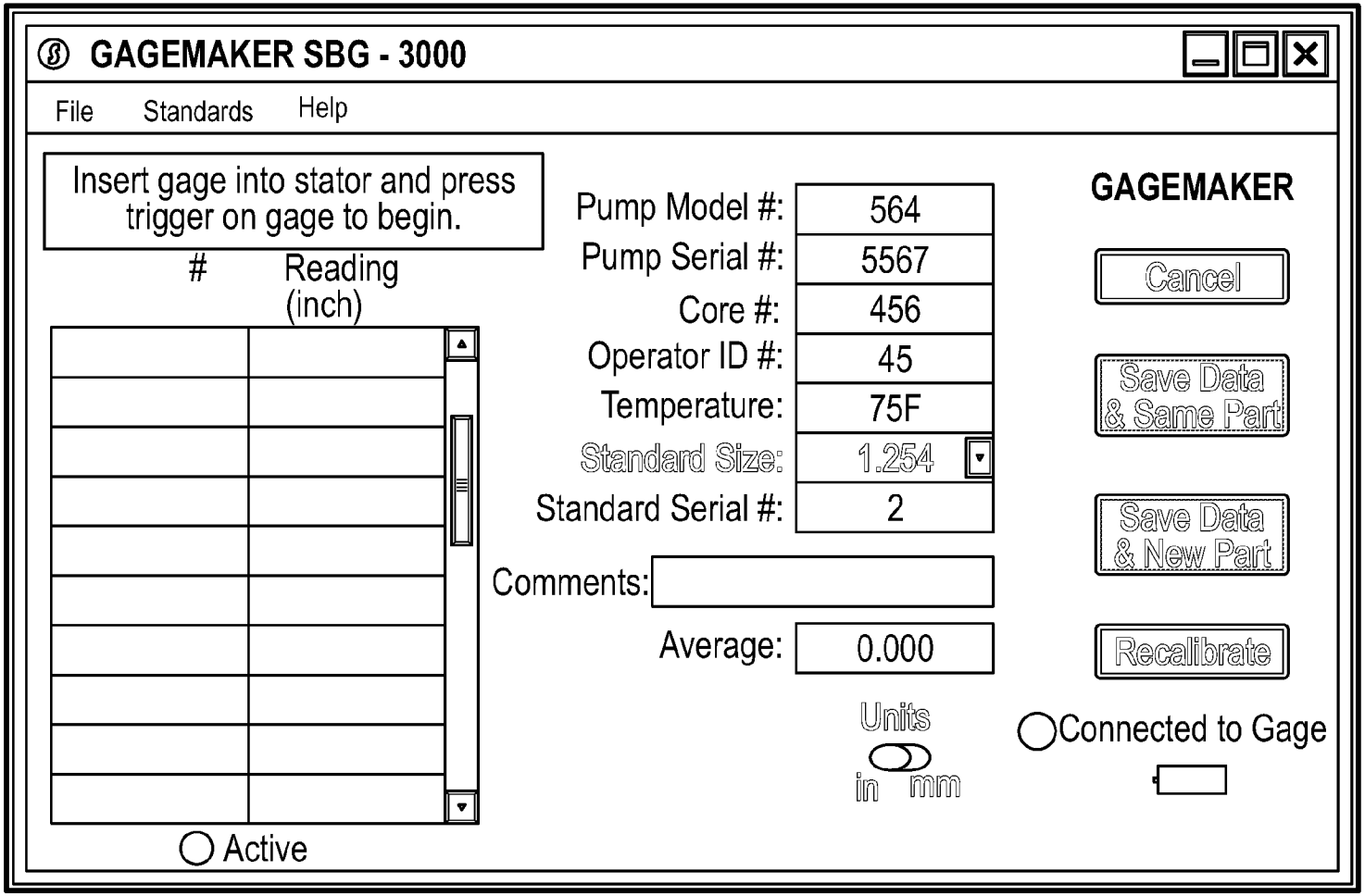
Figure 10G:
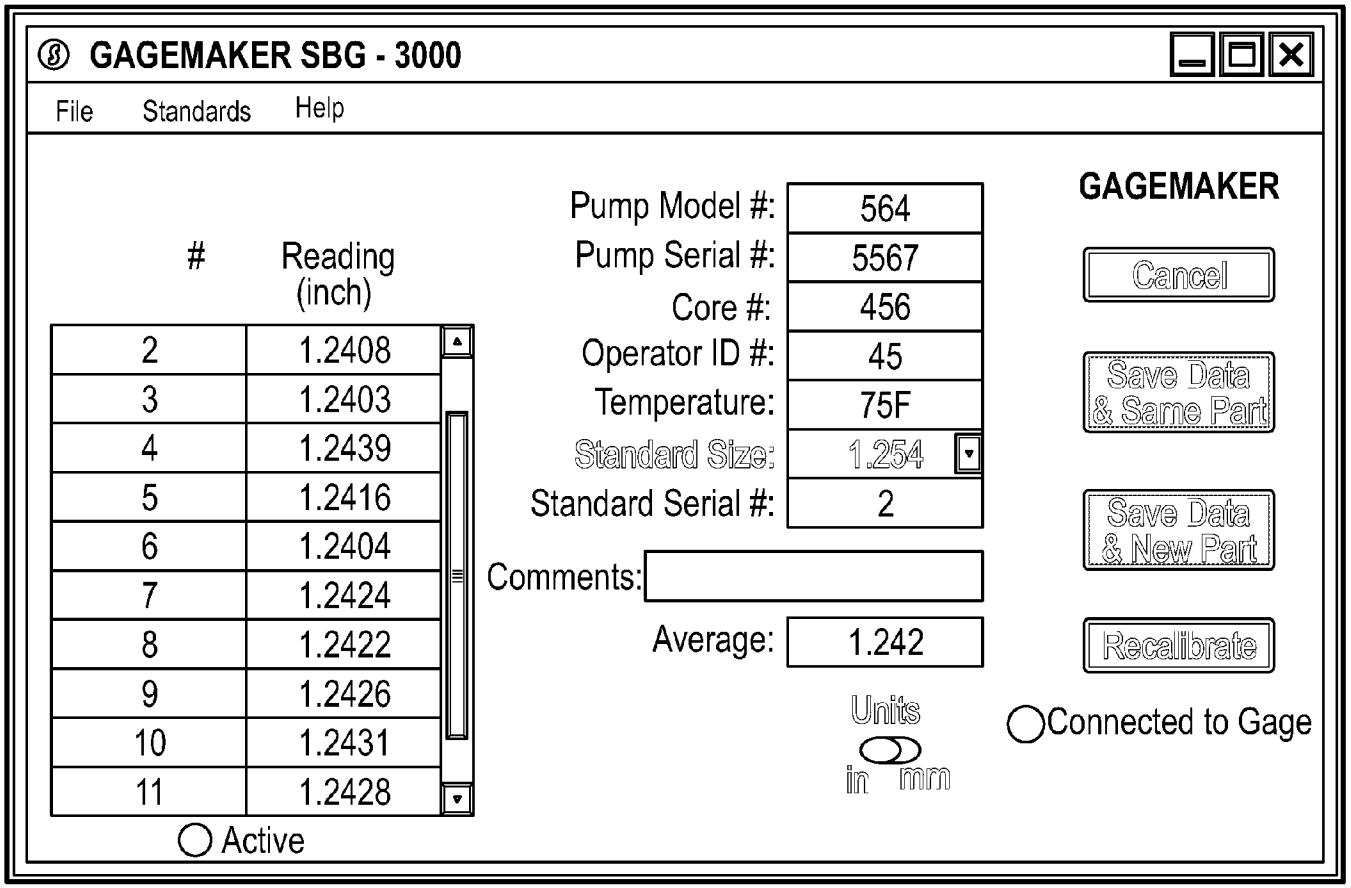

FIG. 10E illustrates the use of the described device to inspect an actual specific stator bore. As reflected in the figure, the specific device may first be identified by, for example the user typing in a serial number associated with the device. Alternately, the identifying information may be obtained via bar code or other scannable information. In addition to inputting identifying information, other information about the device under inspection (e.g., compound, tolerance, etc.) may be added.

After the identifying information about the device under inspection is imputed into the man-machine interface, the device may be inserted into the stator bore, the measurement button (or trigger depressed) and the device swept through the gauge so that the contact wheel sweeps over all or a portion of the stator bore to be inspected. The device may then generate a report identifying each minor diameter detected and, for each minor diameter, information corresponding to: (i) the deviation from the reference location established in the calibration process and (ii) the actual calculated minimum diameter. This is reflected in FIG. 10G. This process may be repeated for accuracy and/or, for longer length stator bores, repeated from the other side of the bore.

FIGS. 11A-11F illustrate screen-shots from a representative man-machine interface in the form of a smart phone device that are helpful in describing a process for using the device described herein. The process is similar to that described above in connection with FIGS. 10A-10H. At an initial point, represented by FIG. 11A, the device is calibrated for use with respect to the inspection of a stator of a particular size. This process can involve initiating the calibration process as reflected in FIG. 11A, and then selecting a specific model of a stator bore to be inspected as reflected in FIG. 11B. In the illustrated embodiment, once the stator bore model to be inspected is selected, the man-machine interface may perform a lookup and provide the user with a visual indication of the specific shoe (or other size adjuster) to be used to permit proper inspection of a stator bore of the desired size. This is reflected in FIG. 11C.

Figure 11B:
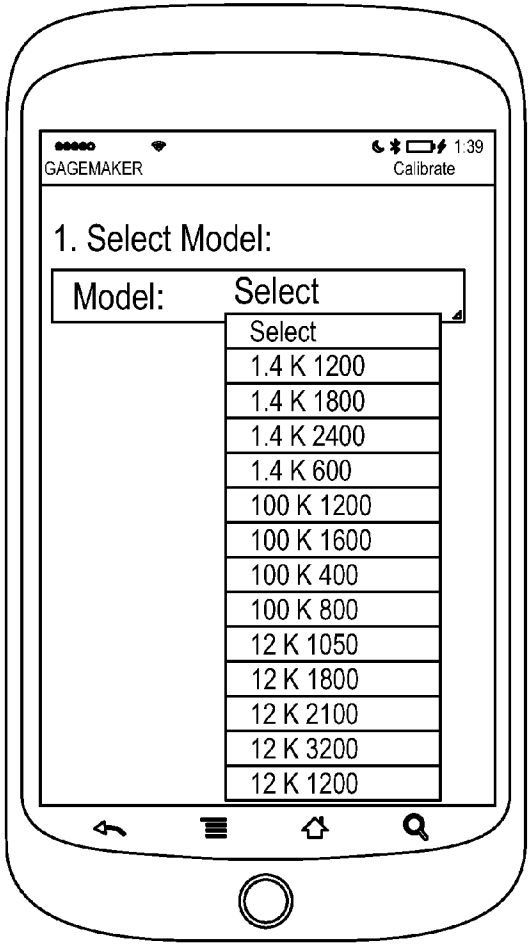
FIGS. 11A-11F illustrate simulated "screenshots" of an alternative exemplary man-machine interface that can be used with a stator bore gage as taught herein and a method of using the described stator bore gages.
Figure 11A:
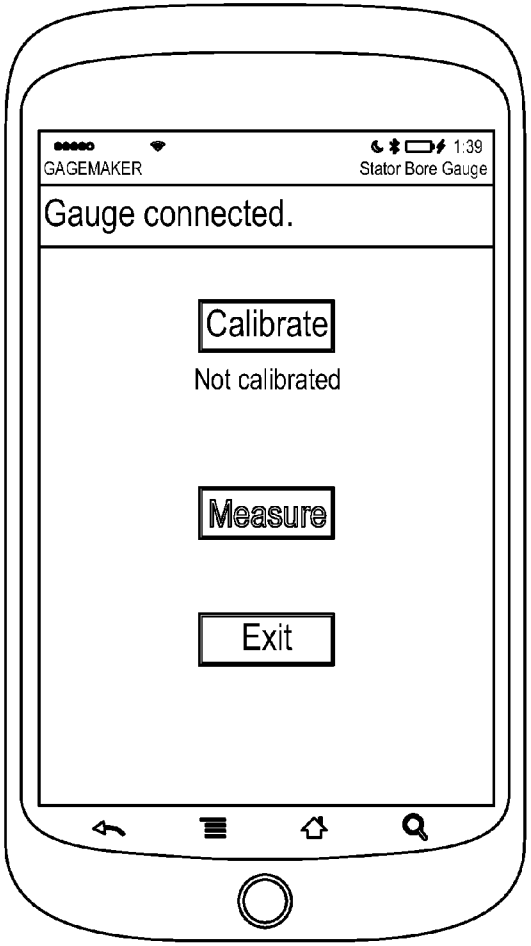
Figure 11D:
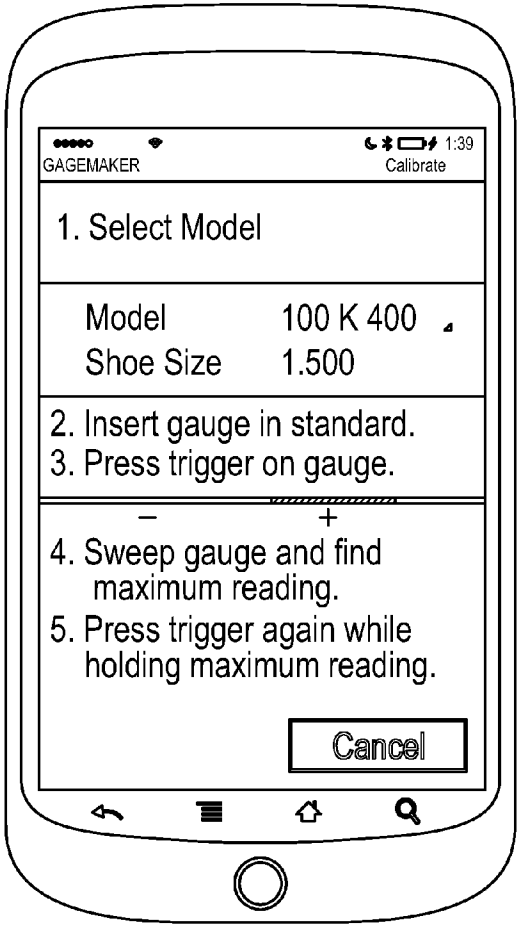
Figure 11C:
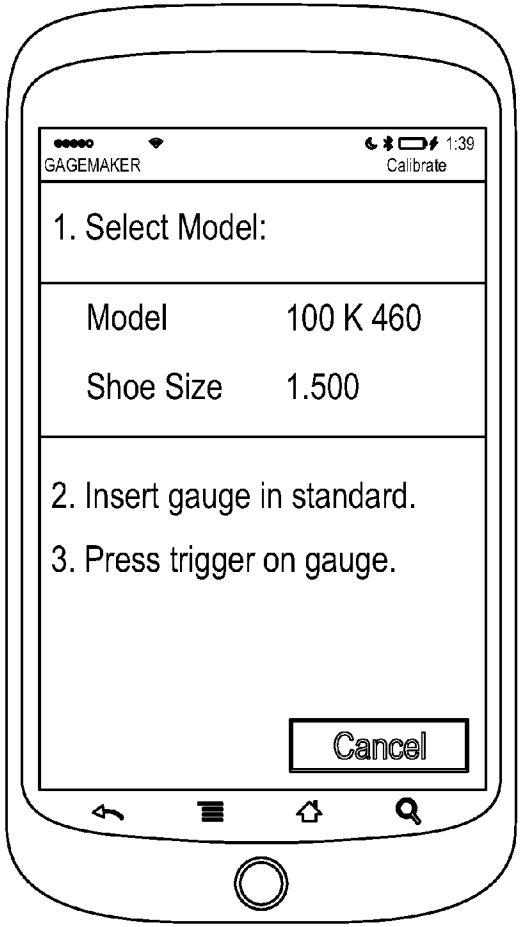
Figure 11F:
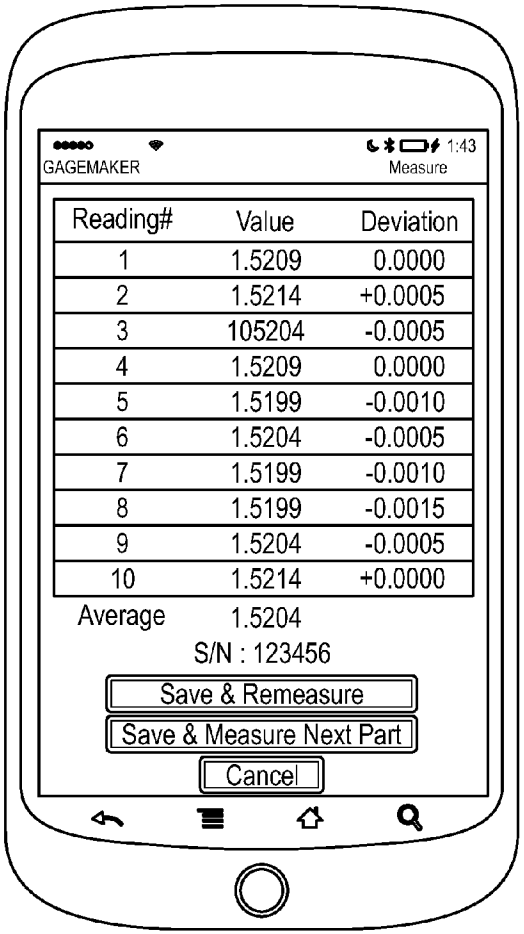

Once the appropriate shoe (or other sizing device) is selected and properly attached, the detecting portion of the device (e.g., the portion with the contact wheel) is inserted into a standard that corresponds to the nominal size of the stator bore to be inspected. The device is then moved back and forth until a maximum reading of the gage is located. This is done to position the gage at one of the minor diameter points of the stator bore. A graphic may be provided, as shown in FIG. 11D, to allow the user to properly locate maximum point. Once the device is properly positioned and a maximum reading is obtained, the device may be calibrated by the user depressing the measurement trigger during the calibration phase, depressing a separate calibration button, or interfacing with the man machine interface.

In the described example, the calibration of the device essentially sets a zero reference for the device. Once the device is calibrated, differential measurements may be provided where the measurements reflect the extent of deviation from the reference point established during the calibration process. In general, the calibration process should be performed when a device calibrated for one stator size is to be used with another size and each time the device is powered on, although if the device is to be used to inspect stators of identical nominal size, calibration upon each power-on may be unnecessary.

Figure 11E:
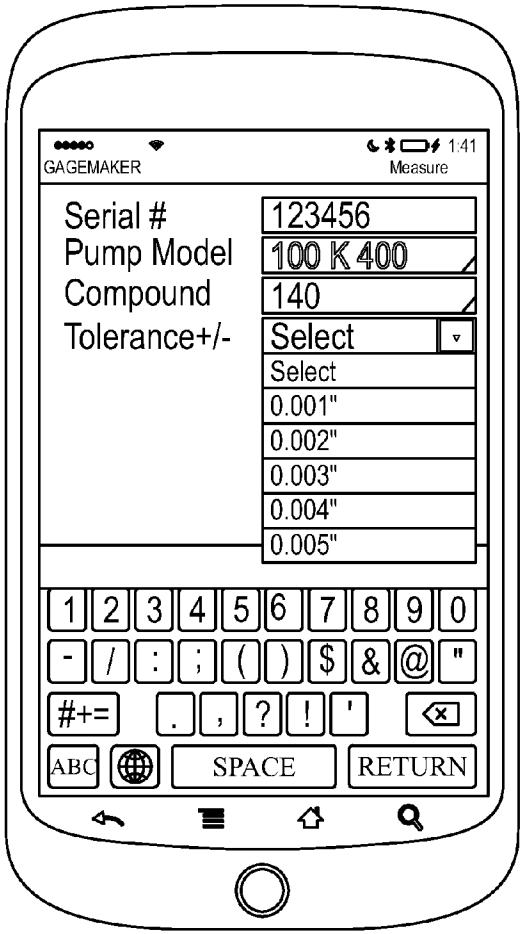

FIG. 11E illustrates the use of the described device to inspect an actual specific stator bore. As reflected in the figure, the specific device may first be identified by, for example the user typing in a serial number associated with the device. Alternately, the identifying information may be obtained via bar code or other scannable information. In addition to inputting identifying information, other information about the device under inspection (e.g., compound, tolerance, etc.) may be added.

After the identifying information about the device under inspection is imputed into the man-machine interface, the device may be inserted into the stator bore, the measurement button (or trigger depressed) and the device swept through the gauge so that the contact wheel sweeps over all or a portion of the stator bore to be inspected. The device may then generate a report identifying each minor diameter detected and, for each minor diameter, information corresponding to: (i) the deviation from the reference location established in the calibration process and (ii) the actual calculated minimum diameter. This is reflected in FIG. 11F. This process may be repeated for accuracy and/or, for longer length stator bores, repeated from the other side of the bore.

Figure 12:
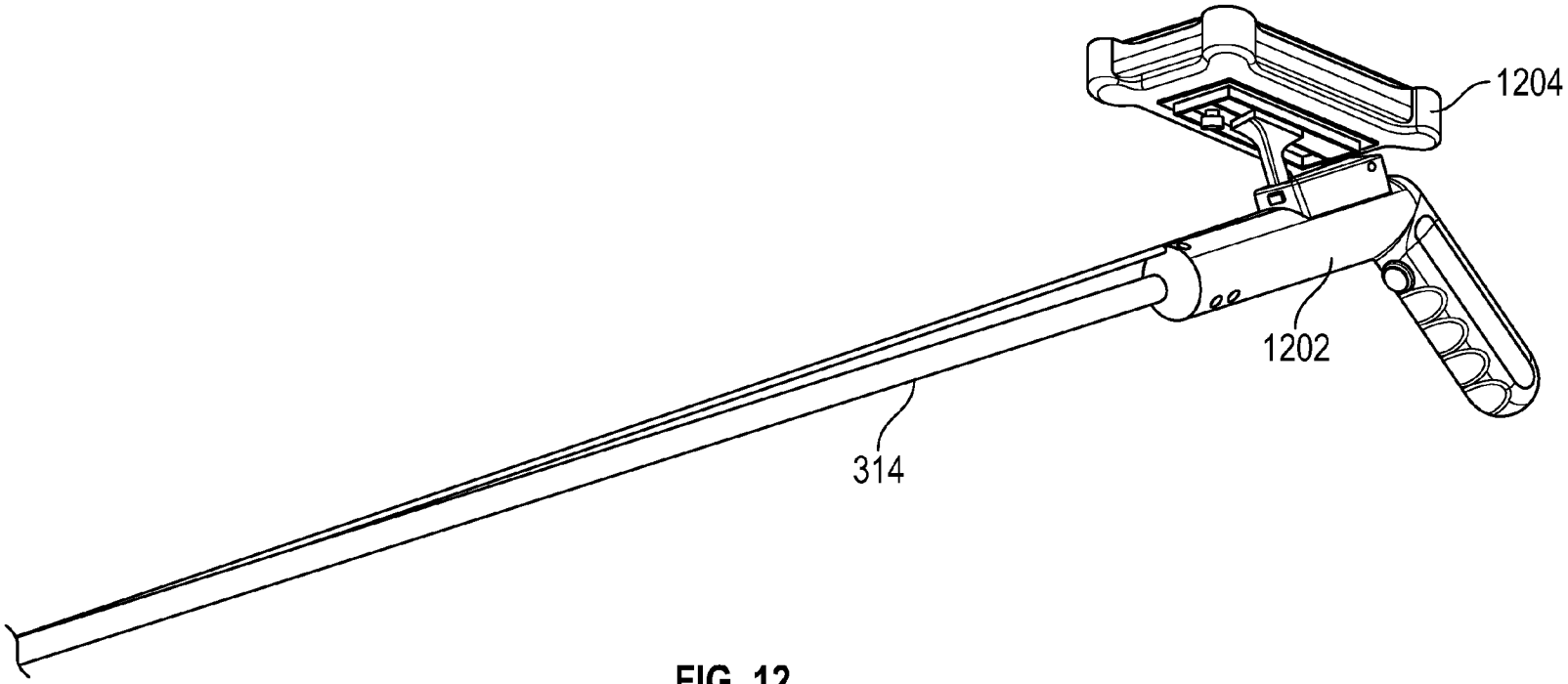
FIG. 12 illustrates an alternative construction of the stator bore gauge described herein.
Figure 13A:
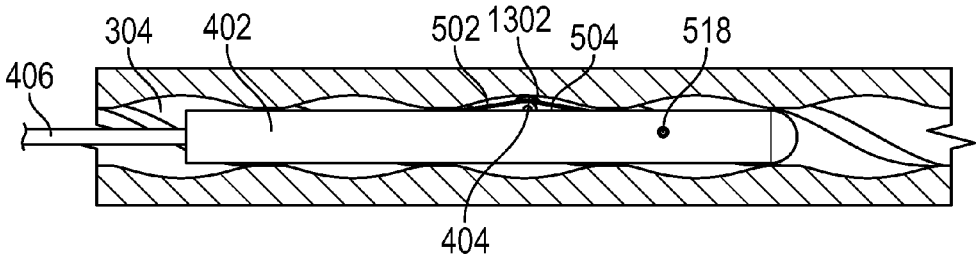
FIGS. 13A-13D illustrate a method by which a stator bore gage constructed in accordance with certain teachings may use to detect the ridges or lobes within the stator bore and determine the minimum diameters of the stator bore.
Figure 13B:
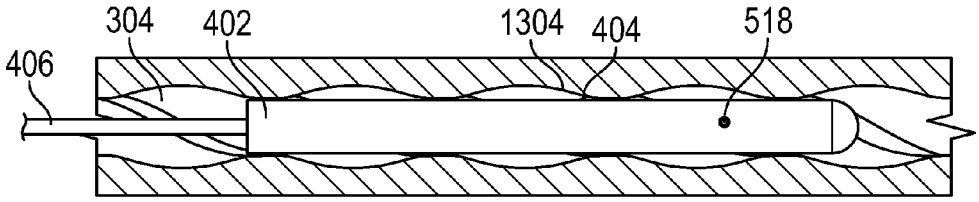
Figure 13C:
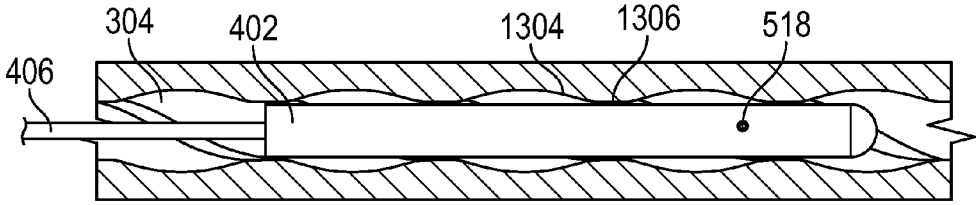
Figure 13D:
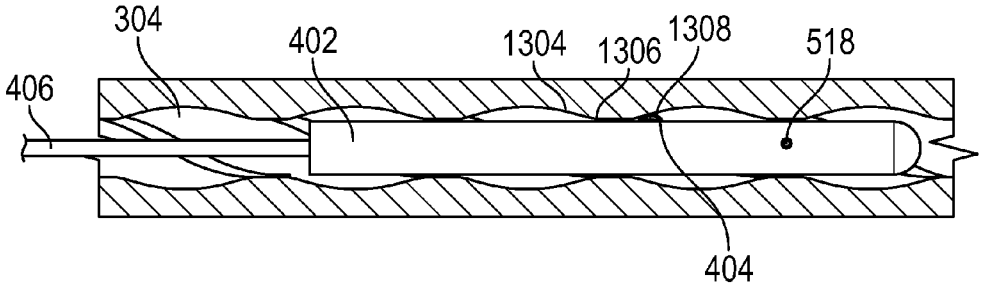

FIG. 12 illustrates an alternate embodiment where the man machine interface takes the form of a smart phone, the handle assembly 310 is in the form of a pistol grip 1202 and includes a cradle 1204 for mounting the smart phone device. Further alternate constructions of the device are envisioned.

One exemplary process used to identify the minimum diameters points within the stator bore is depicted in FIGS. 13A-13D. FIGS. 13A-13D reflect a process that may be used with a linear sensor 510 or angular sensor 524 that provides a signal (e.g., a numerical output) where the signal corresponds to a specific location at the tip of the probe. In the example of FIGS. 13A-13D, the probe is one such that, when used in an arrangement as described above (e.g., in connection with FIG. 5B), the signal may be at its peak when the contact wheel corresponds to a stator bore minimum. While the process illustrated in FIGS. 13A-13D involves pushing the gage through the stator bore, it will be appreciated that gages according to the present invention may be pushed and/or pulled through the stator bore.

As described above in connection with FIGS. 5A-5C and with reference to FIGS. 13A-13D, the contact wheel 404 and the associated elements (e.g., members 502, 504, 406 and 512) are such that the contact wheel is able to make contact with the inner diameter portions of the stator and may be blocked by the various element from contacting the portions of the stator corresponding to the maximum diameter of the stator. Alternately, the contact wheel may be allowed to contact all surfaces of the stator bore to provide both minimum, maximum diameters and all diameters in between. As such, as the contact wheel 404 is moved across the stator bore surfaces, the count may, at one exemplary point 1302 (FIG. 13A) be at a minimum point where the contact wheel is not contacting the stator bore, but is at a fixed point resulting from the arrangement described above with respect to FIGS. 5B-5C (or is contacting a maximum diameter). As the device is swept through the bore, a point may be reached 1304 (FIG. 13B) where the contact wheel contacts the interior of the stator bore and the operation of the device begins to move the tip 404 of the linear probe. At that point, the count output from the probe may begin to increase. Because of the sensitivity of the probe, and the non-uniformity of the interior bore, the count may not increase smoothly and may be subject to variations due to minor imperfections in the stator bore surface. As the wheeled contact rolls over the stator bore, it may eventually encounter a point 1306 (FIG. 13C), typically associated with the maximum count/number corresponding to a minimum diameter of the stator. After that, the count from the probe may begin to decrease as the device is drawing across the bore and the diameter increases 1308 (FIG. 13D), again subject to count changes resulting from minor imperfections of the stator bore.

In one embodiment, the device (for example the electronics within the handle end) may monitor the numeric values from the probe and: (i) look for a peak value 1306 and (ii), if no intervening peak value is reached, look for a point when the count is some specific amount below the peak value 1308. Once the count drops from the peak value 1306 to the point a specific amount below the peak value 1308 or 1304 in the absence of another intervening peak value, the device can then determine that a true peak count (corresponding to a stator bore minimum in the present example) has been reached. In the event that another intervening peak value is reached after the initial peak value is detected, the process may repeat. In this manner, the present example can accurately detect the true minimum diameters of the stator bores under inspection.

In another embodiment, the device will first look for an increase in the value from a point (e.g., the zero point), such as point 1304 and will monitor the system to detect an increasing count (which would occur as the wheeled contact rolls to and past point 1304) followed by a decreasing count (which would occur as the wheeled contact rolls to and past point 1308) followed by a second increase in the count (which will occur as the roller moves to and past point 1310). Upon the detection of the second increasing count, the device will then look for the maximum count that occurred between the first increasing count and the second increasing count and associate that maximum count (in the example the count at point 1306) with the minimum bore diameter. As another example, it is expected that as the probe 402 is pushed through the stator bore the sensor signal will increase representing a decreasing interior diameter. These diameters representations may be recorded in circular buffer memory, FIFO buffer, static memory associated with the gage or transmitted or telemetered to a device or location remote from the gage. A maximum signal (i.e., minimum diameter) can be determined from the signal beginning to decrease, which represents an increasing stator bore diameter. The stored diameter representations can be searched for the maximum value, or alternately, a maximum value can be interpolated or otherwise calculated from the recorded values. Still further, the recorded data can be used to generate a plot or profile of the stator bore interior.

Once a count corresponding to a minimum diameter is obtained, the device can then use the X vs. Y characterization data, and the reference set point, to calculate the actual minimum stator bore measurement for each minimum diameter.

It should be appreciated that the described process is exemplary only and that other processes could be used. For example, alternative methods could be used for linear probes where the count decreased (rather than increased) as the contact wheel approached a stator bore minimum.

Figure 14:
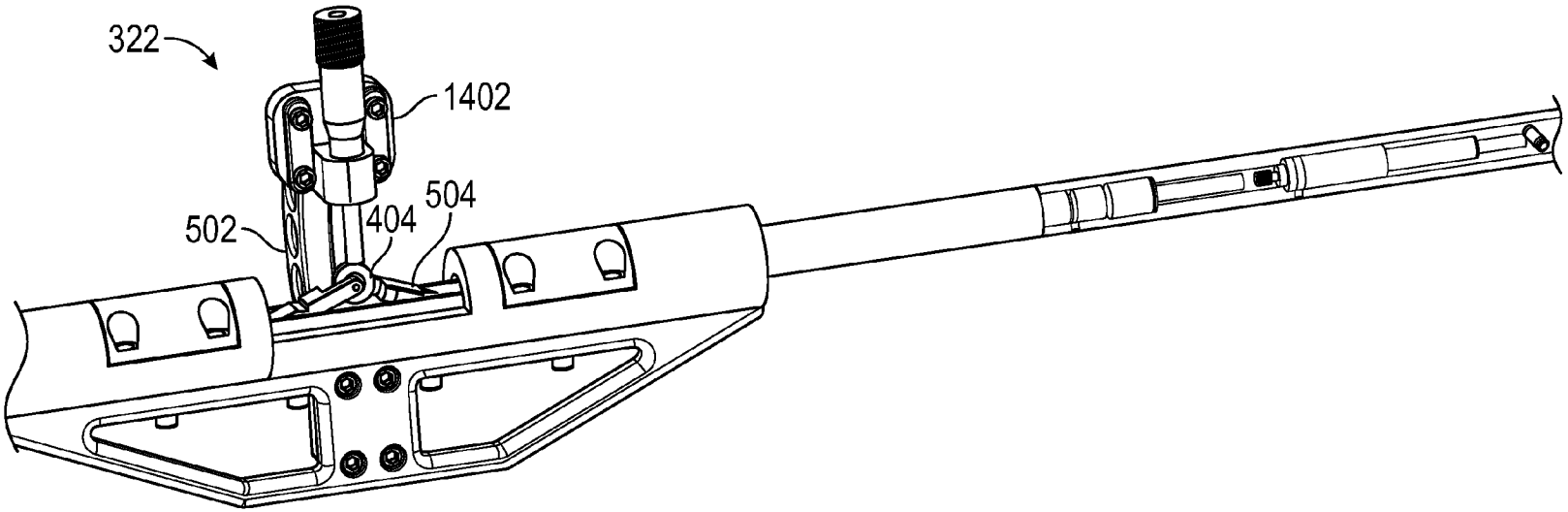
FIG. 14 illustrates an apparatus that can be used to characterize a stator bore gauge according to the present invention.

For purposes of ensuring accuracy of the device, it is beneficial for each unit of the device to be characterized after its assembly and/or after any components of the device are modified. This is because there may be variations in the manufacture of the components of the device that will cause each device to operate in a slightly different manner than other devices of similar construction. An exemplary apparatus and a process for characterizing a given device are depicted in FIG. 14. Referring to FIG. 14, a wheel gage assembly is depicted as mounted in characterization mount. The mount includes a brace for fixing the wheel gauge assembly in a fixed location and a micrometer calibrating reference device 1402. The calibration reference device 1402 includes an extending member that contacts the wheel of the wheel assembly. It can be controlled to provide precise, accurate movements of the extending member, such that the extending member can be moved in precise steps of $^{1}/_{10,000}$ inch or less.

To characterize device using the structure of FIG. 14, the extending member of the reference device 1402 is first moved to a nearly fully retracted position that causes the wheel to move to a fully or near-fully extended position. The probe value is then "zeroed" out. The extended member is then extended in controlled steps (e.g., steps of $^{1}/_{10,000}$ of an inch) and at each step the probe value is recorded. By moving the extended member from the position corresponding to the prove zero position to a position that would correspond to something smaller than the smallest stator bore inner diameter to be detected by the device, a relationship between the count of the probe and the distance from the zero position (as determined by the reference device 1402) can be determined. For various reasons, this relationship may be non-linear.

In one embodiment, the values of the distance from zero and the count are used with a curve fitting algorithm to generate a mathematical formula that provides will provide the distance from the zero point (along an axis parallel to the movement of the extending member of the reference device) in response to any given probe value. Any suitable curve-fitting algorithm could be used to generate the formula.

In a second embodiment, the distance vs. prove values are all stored in a table or matrix and the device can use the data to either: (i) select a distance value if the prove value corresponds identically to one of the values obtained during the characterization process or (ii) utilize an interpolation algorithm to generate an estimated distance value by interpolating between data points stored in the characterization process. In both embodiments non-linearities in the device, and the specific distance vs. probe relationship for each individual device, are addressed and the accuracy of the measurements are enhanced.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art may appreciate that not all features of a commercial embodiment of the inventions are described or shown for the sake of clarity and understanding. Persons of skill in this art may also appreciate that the development of an actual commercial embodiment incorporating aspects of the present inventions may require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The inventions have been described in the context of preferred and other embodiments and not every embodiment of the invention has been described. Each component, sub-component or function described with respect to a particular embodiment may be combined with any other component, sub-component or function described with respect to another particular embodiment. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

We claim:

1. A device for measuring a plurality of inside diameters of an interior surface (304), comprising:

a detector assembly comprising a body, a wheel assembly and a transducer assembly;

the body having a slide portion configured for sliding contact with an interior surface of a component;

the wheel assembly coupled to the body substantially opposite the slide portion such that at least a portion of the wheel assembly protrudes from the body for rolling contact with the interior surface;

the detector assembly configured for relative displacement between the wheel assembly and the slide portion in response to changes in the interior surface diameter;

the transducer assembly located in the body, coupled to the wheel assembly and configured to transduce displacement of the wheel assembly into electrical signals representative of an interior surface diameter of the component; and a translation assembly coupled to the detector assembly and configured to insert the detector assembly into the interior of the component and to withdraw the detector assembly from the interior of the component.

2. The device of claim 1, wherein the wheel assembly further comprises a support mechanism that converts radial displacement into longitudinal displacement.

3. The device of claim 2, wherein the transducer assembly comprises a linear displacement sensor.

4. The device of claim 2, wherein the wheel assembly provides about 0.2 inches of radial displacement.

5. The device of claim 1, wherein the wheel assembly comprises a biasing element configured to bias the wheel to a maximum radial displacement from the slide portion.

6. The device of claim 5, wherein the biasing force supplied by the biasing element does not cause deformation of the interior surface.

7. The device of claim 6, wherein the biasing force supplied by the biasing element is about 0.3 pounds or less.

8. The device of claim 1, wherein the translation assembly comprises a handle portion having a power source and a conduit for communicating signals from the transducer assembly to the handle portion.

9. The device of claim 8, wherein the translation assembly has an adjustable length.

10. The device of claim 8, wherein the translation assembly comprises one or more joints configured to allow relative movement between the body and the handle.

11. The device of claim 10, wherein the one or more joints is a ball and socket joint or a u-joint.

12. The device of claim 1, further comprising a man-machine interface with a visual display configured to show representations of the electrical signals from the transducer assembly.

13. The device of claim 12, wherein the man-machine interface is associated with the handle portion.

14. The device of claim 12, wherein the man-machine interface communicates wirelessly with the detector assembly.

15. The device of claim 1, wherein the detector assembly is configured to make continuous measurements of the interior surface diameters.

16. The device of claim 1, wherein the body comprises one or more removable shoes each shoe having a slide portion.

17. A device for measuring a plurality of inside diameters of a positive displacement motor stator, comprising:

a detector assembly comprising a body, a wheel assembly and a transducer assembly;

the body having one or more slide portions configured for sliding contact with an interior surface of the stator;

the wheel assembly coupled to the body substantially opposite the at least one slide portion such that at least a portion of the wheel assembly protrudes from the body for rolling contact with the interior surface of the stator;

the detector assembly configured for relative displacement between the wheel assembly and the at least one slide portion in response to changes in the interior surface diameter;

the transducer assembly located in the body, operatively coupled to the wheel assembly and configured to transduce displacement of the wheel assembly into electrical signals representative of an interior surface diameter of the stator;

a translation assembly coupled to the detector assembly and configured to insert the detector assembly into the interior of the stator and to withdraw the detector assembly from the interior of the stator;

the translation assembly having an adjustable length and comprising a handle portion having a power source and a conduit for communicating signals from the transducer assembly to the handle portion translation and one or more joints configured to allow relative rotation between the body and the handle; and a man-machine interface configured to wirelessly communicate with the body and to display the diametrical measurements of the interior surface as the body is withdrawn from the stator.

18. A method of measuring a plurality of inside diameters of an interior surface of a component using the device of claim 1, comprising:

calibrating the device so that the electrical signals provided by the transducer assembly are associated with diametrical measurements;

setting the maximum diametrical dimension between the slide portion and the wheel assembly to fit the interior surface to be measured;

inserting the body into the interior of the component;

measuring the diameter of the interior surface as the body is withdrawn from the component; and determining a minimum diameter of the interior surface of the component.

19. The method of claim 18, further comprising a man-machine interface configured to wirelessly communicate with the body and to display the diametrical measurements of the interior surface as the body is withdrawn from the component.

20. A method of measuring a plurality of inside diameters of an interior surface of a stator using the device of claim 17, comprising:

calibrating the device so that the electrical signals provided by the transducer assembly are associated with diametrical measurements;

setting the maximum diametrical dimension between the slide portion and the wheel assembly to fit the interior surface to be measured;

inserting the body into the interior of the stator;

measuring the diameter of the interior surface as the body is withdrawn from the stator; and determining a minimum diameter of the interior surface of the stator; and determining the size of a rotor for use with the stator based on one or more of the diametrical measurements obtained while withdrawing the body from the stator.

* * * * *